US011342651B2

(12) United States Patent
Ma et al.

(10) Patent No.: US 11,342,651 B2
(45) Date of Patent: May 24, 2022

(54) ANTENNA APPARATUS AND TERMINAL DEVICE

(71) Applicant: Huawei Technologies Co., Ltd., Shenzhen (CN)

(72) Inventors: Guozhong Ma, Shenzhen (CN); Fengwen Chen, Dongguan (CN); Dongxing Tu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 20 days.

(21) Appl. No.: 17/081,444

(22) Filed: Oct. 27, 2020

(65) Prior Publication Data

US 2021/0044003 A1 Feb. 11, 2021

Related U.S. Application Data

(63) Continuation of application No. PCT/CN2018/085204, filed on Apr. 28, 2018.

(51) Int. Cl.

| | |
|---|---|
| ***H01Q 13/10*** | (2006.01) |
| ***H01Q 1/24*** | (2006.01) |
| ***H01Q 5/307*** | (2015.01) |
| ***H01Q 1/52*** | (2006.01) |

(52) U.S. Cl.

CPC ..... *H01Q 1/243* (2013.01); *H01Q 1/521* (2013.01); *H01Q 5/307* (2015.01); *H01Q 13/10* (2013.01)

(58) Field of Classification Search

CPC ..... H01Q 1/243; H01Q 1/521; H01Q 5/307; H01Q 13/10

See application file for complete search history.

(56) References Cited

U.S. PATENT DOCUMENTS

| | | | |
|---|---|---|---|
| 9,413,058 | B1 | 8/2016 | Kuo et al. |
| 2012/0169547 | A1 | 7/2012 | Oh et al. |
| 2017/0338546 | A1 | 11/2017 | Wong et al. |
| 2018/0026340 | A1 | 1/2018 | Chih et al. |

(Continued)

FOREIGN PATENT DOCUMENTS

| | | | |
|---|---|---|---|
| CN | 201708248 | U | 1/2011 |
| CN | 103811864 | A | 5/2014 |

(Continued)

OTHER PUBLICATIONS

Zhang Iiwan, "Research on The Thechnology of Antennas for Metal-ring-frame Smartphone Applications," 2016, 2 pages (abstract).

*Primary Examiner* — Joseph J Lauture
(74) *Attorney, Agent, or Firm* — Conley Rose, P.C.

(57) ABSTRACT

An antenna apparatus includes a first medium- and high-band (MBHB) antenna, and a terminal device includes a metal middle frame and a metal frame, a slot is opened on a side of the metal middle frame, and the MBHB antenna includes a first feed point, a first primary feed, and a radiating slot constituted by the metal middle frame and the metal frame, a first end of the radiating slot is connected to the side slot of the metal middle frame and is grounded using the metal middle frame, and an opening of a second end of the radiating slot is disposed at a bottom edge of the metal frame, where the first primary feed is connected to the first feed point and is spaced from the radiating slot, and the first primary feed is orthogonal to the radiating slot.

20 Claims, 24 Drawing Sheets

(56) References Cited

U.S. PATENT DOCUMENTS

| | | | | |
|---|---|---|---|---|
| 2018/0108984 | A1 | 4/2018 | Wu et al. | |
| 2018/0233807 | A1 | 8/2018 | Ma et al. | |
| 2018/0358700 | A1 | 12/2018 | Yamagajo et al. | |
| 2021/0218136 | A1* | 7/2021 | Wang | H01Q 1/50 |

FOREIGN PATENT DOCUMENTS

| | | | |
|---|---|---|---|
| CN | 104103888 | A | 10/2014 |
| CN | 104505574 | A | 4/2015 |
| CN | 105098323 | A | 11/2015 |
| CN | 205039250 | U | 2/2016 |
| CN | 105742794 | A | 7/2016 |
| CN | 105932408 | A | 9/2016 |
| CN | 205752543 | U | 11/2016 |
| CN | 205846211 | U | 12/2016 |
| CN | 106450658 | A | 2/2017 |
| CN | 106537690 | A | 3/2017 |
| CN | 107959117 | A | 4/2018 |
| WO | 2017130348 | A1 | 8/2017 |

* cited by examiner

ANTENNA APPARATUS AND TERMINAL DEVICE

CROSS-REFERENCE TO RELATED APPLICATIONS

This application is a continuation application of International Patent Application No. PCT/CN2018/085204, filed on Apr. 28, 2018, the disclosure of which is hereby incorporated by reference in its entirety.

TECHNICAL FIELD

This application relates to the field of electronic devices, and in particular, to an antenna apparatus and a terminal device.

BACKGROUND

In recent years, due to market demand, metal frames plus glass back covers are used for high-end and medium-end mobile phones, for example, GALAXY S8, IPHONE 8, and IPHONE X that are recently released. Due to this identification (ID) guidance, a design concept of an antenna of a mobile phone has also undergone a great change. Using a metal frame as the antenna has become a mainstream design. Currently, a low-band (LB) tunable T antenna is widely used in the industry.

A feature of the T antenna is to open two slits on sides of the mobile phone, and the biggest problem of opening the slits on the sides is "dead grip". The slits on the sides are located in a strong radiation area of the antenna. When the side slit is gripped using a hand, antenna efficiency decreases greatly. In addition, there is a best antenna clearance area at the bottom of the mobile phone, and only one main antenna (an LB antenna or a medium- and high-band antenna) can be designed, because the T antenna needs a relatively long radiating element, to be specific, the T antenna has a relatively high requirement for clearance.

Long term evolution (LTE) and WI-FI have increasing requirements for a quantity of multiple-input multiple-output (MIMO) antennas. Eight MIMO antennas of a fifth-generation mobile communications technology (5G) need to cover three time-division duplex (TDD) bands, namely, N77, N78, and N79 (3.3 gigahertz (GHz) to 3.8 GHz, 3.3 GHz to 4.2 GHz, and 4.4 GHz to 5.0 GHz). It is difficult to cover the three bands simultaneously using a single antenna. It is estimated that a quantity of MIMO antennas of the 5G increase by at least 8 to 12. However, a requirement for a proportion of a large screen to a mobile phone makes clearance of an antenna smaller and smaller. How to reduce a requirement of an antenna of a mobile phone for clearance becomes an urgent problem to be resolved.

SUMMARY

In view of this, this application provides an antenna apparatus and a terminal device, to reduce a requirement of an antenna of a mobile phone for clearance.

According to a first aspect, an antenna apparatus is provided, and the antenna apparatus is applied to a terminal device. The antenna apparatus includes a first medium- and high-band antenna, the terminal device includes a metal middle frame and a metal frame, a slot is opened on a side of the metal middle frame, and the medium- and high-band antenna includes a first feed point, a first primary feed, and a radiating slot, where the radiating slot is constituted by the metal middle frame and the metal frame, a first end of the radiating slot is connected to the side slot of the metal middle frame and is grounded using the metal middle frame, and an opening of a second end of the radiating slot is disposed at a bottom edge of the metal frame, where the first primary feed is connected to the first feed point, and the first primary feed is spaced from the radiating slot, and the first primary feed is orthogonally crossed over the radiating slot.

According to the antenna apparatus in this embodiment of this application, a coupling feeding manner and a slot radiation manner are used for the first medium- and high-band antenna, and a size of an antenna can be reduced. The helps reduce a requirement of the antenna for clearance.

In some possible implementations, slits (a first bottom slit and a second bottom slit) are opened at the bottom edge of the metal frame, and the second end of the radiating element is open at an opening of the bottom slit of the metal frame.

In some possible implementations, a length of the bottom slit is 1.5 millimeter (mm).

According to the antenna apparatus in this embodiment of this application, the slits are opened at the bottom edge of the metal frame, to avoid impact of a hand on antenna efficiency when the slits are opened on sides.

With reference to the first aspect, in some possible implementations of the first aspect, the antenna apparatus further includes an LB antenna, and the LB antenna includes a first straight arm, a second straight arm, a second feed point, and a ground point, where the ground point is located on a right side of the second feed point, a first end of the first straight arm is connected to the second feed point, and a second end of the first straight arm is connected to a first end of the second straight arm, and a second end of the second straight arm is connected to the ground point.

According to the antenna apparatus in this embodiment of this application, the first straight arm and the second straight arm may constitute two overlapping dipoles. Electric lengths are slightly different, to help increase a bandwidth of the LB antenna.

In some possible implementations, the first straight arm and the second straight arm are located in a plane parallel to a thickness direction of the terminal device.

According to the antenna apparatus in this embodiment of this application, the first straight arm and the second straight arm are designed in the plane parallel to the thickness direction of the terminal device, to help reduce a requirement of an antenna for a size of a length direction of the terminal device.

With reference to the first aspect, in some possible implementations of the first aspect, the LB antenna further includes a matching circuit, the matching circuit is configured to isolate interference from the medium- and high-band antenna to the LB antenna, and the first straight arm is connected to the second feed point using the matching circuit.

Medium- and high-band antennas and the LB antenna exist in the antenna apparatus in this embodiment of this application. Therefore, the matching circuit is designed to help isolate mutual interference between the LB antenna and the medium- and high-band antennas.

With reference to the first aspect, in some possible implementations of the first aspect, the LB antenna further includes a tuning point, the tuning point is located on a left side of the second feed point, the tuning point is connected to a first end of a switch, and a second end of the switch is connected to at least one load.

With reference to the first aspect, in some possible implementations of the first aspect, the first straight arm is connected to the second straight arm using a metal sheet.

According to the antenna apparatus in this embodiment of this application, a wide metal sheet is added at a junction between the first straight arm and the second straight arm, to help reduce an initial resonant frequency of the LB antenna.

With reference to the first aspect, in some possible implementations of the first aspect, the metal frame includes the first bottom slit and the second bottom slit, and the LB antenna is located between the first bottom slit and the second bottom slit.

With reference to the first aspect, in some possible implementations of the first aspect, the antenna apparatus further includes a second medium- and high-band antenna, the second medium- and high-band antenna further includes a third feed point and a radiating element, and the radiating element starts from a ground point of a first side slot and crosses the metal frame to a ground point of a second side slot.

In some possible implementations, the third feed point is located on the metal frame, and the radiating element is excited in a direct feeding manner.

According to the antenna apparatus in this embodiment of this application, the radiating element of the first medium- and high-band antenna and the radiating element of the LB antenna may be repeatedly used for the second medium- and high-band antenna, to construct a third independent antenna in the terminal device.

With reference to the first aspect, in some possible implementations of the first aspect, the second medium- and high-band antenna further includes a second primary feed, the second primary feed is located on a sound box of the terminal device, and the second primary feed is connected to the third feed point.

According to the second medium- and high-band antenna in this embodiment of this application, the second primary feed is placed on the sound box such that the radiating element may be excited in the coupling feeding manner.

In some possible implementations, the second medium- and high-band antenna is located on the bottom left side of the terminal device.

In some possible implementations, if a printed circuit board (PCB) board exists on a left side of the terminal device, the second medium- and high-band antenna may be alternatively implemented using a method for implementing the first medium- and high-band antenna.

With reference to the first aspect, in some possible implementations of the first aspect, the ground point is connected to a capacitor, and the capacitor is configured to isolate the first medium- and high-band antenna from the second medium- and high-band antenna.

The two medium- and high-band antennas exist in the antenna apparatus in this embodiment of this application. Therefore, the capacitor is designed to help isolate interference between the two medium- and high-band antennas.

With reference to the first aspect, in some possible implementations of the first aspect, a capacitance value of the capacitor is tunable.

In some possible implementations, the antenna apparatus including structures of the three antennas may be located at the bottom, a side, or the top of the terminal device.

With reference to the first aspect, in some possible implementations of the first aspect, the first primary feed is located above or below the radiating slot, and a spacing between the first primary feed and the radiating slot is within a range of 0.5 mm to 2 mm.

According to a second aspect, a terminal device is provided. The terminal device includes the antenna apparatus according to any one of the first aspect and the possible implementations of the first aspect.

DESCRIPTION OF EMBODIMENTS

The following describes technical solutions of this application with reference to accompanying drawings.

A terminal device in the embodiments of this application may be user equipment, an access terminal, a subscriber unit, a subscriber station, a mobile station, a mobile console, a remote station, a remote terminal, a mobile device, a user terminal, a terminal, a wireless communications device, a user agent, or a user apparatus. The terminal device may alternatively be a cellular phone, a cordless phone, a session initiation protocol (SIP) phone, a wireless local loop (WLL) station, a personal digital assistant (PDA), a handheld device having a wireless communication function, a computing device, another processing device connected to a wireless modem, a vehicle-mounted device, a wearable device, a terminal device in a future 5G network, a terminal device in a future evolved public land mobile network (PLMN), or the like. This is not limited in the embodiments of this application.

Figure 1:
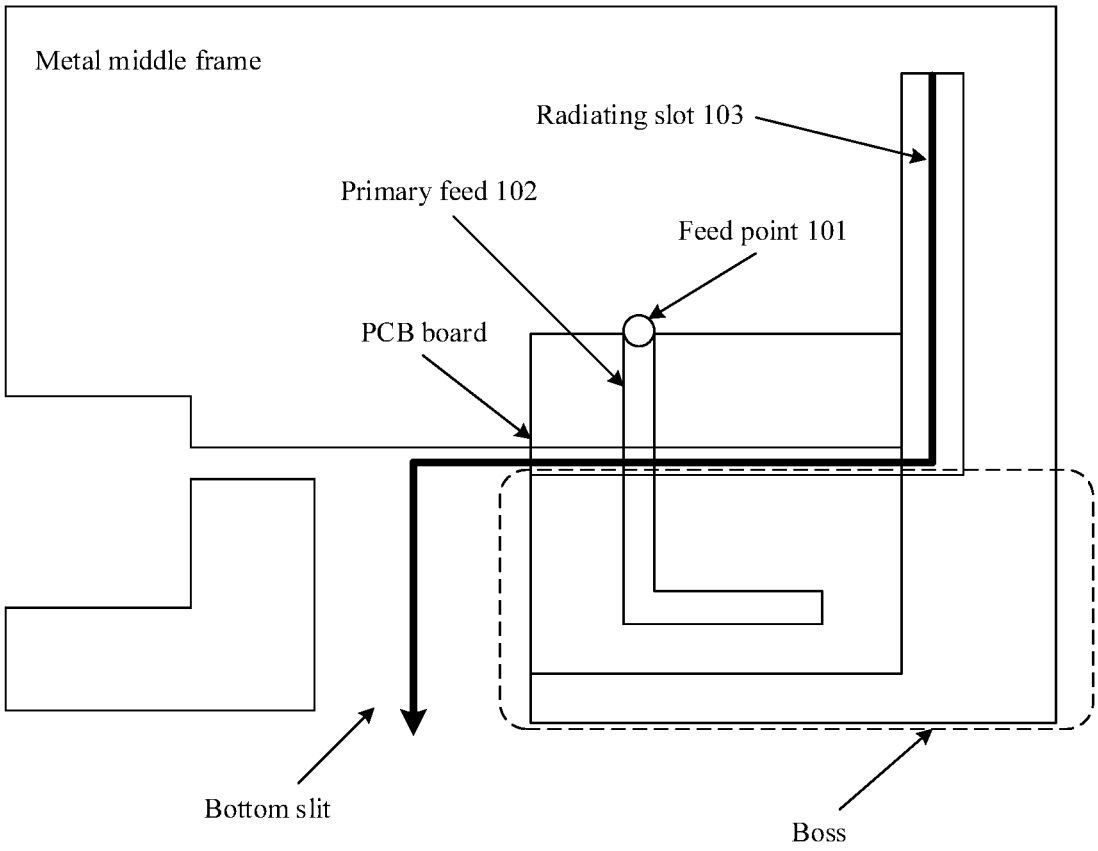
FIG. 1 is a schematic structural diagram of an antenna apparatus according to an embodiment of this application.

FIG. 1 is a schematic structural diagram of an antenna apparatus according to an embodiment of this application. As shown in FIG. 1, the antenna apparatus includes an antenna 100, and a structure of the antenna 100 may be located at the bottom of a terminal device. The terminal device includes a display unit, a metal middle frame, and a metal frame, and the antenna 100 may be set as MHB1 antenna, where a frequency range of the MHB1 antenna is 1.71 GHz to 2.69 GHz. The antenna is a coupled-fed slot antenna, and two side slits (or side slots) may be opened on a side of the metal middle frame. A side slot on the left side of the metal middle frame is a first side slot, and a side slot on the right side of the metal middle frame is a second side slot. Two bottom slits may be opened at a bottom edge of the metal frame, a first bottom slit is located at the bottom left side of the metal frame, and a second bottom slit is located at the bottom right side of the metal frame. FIG. 1 shows four important structural features of the antenna 100 a feed point 101, a primary feed 102, a radiating slot 103, and a boss.

Optionally, a length of the slot opened on the side is 10 mm to 15 mm.

Optionally, a width of the slot opened on the side is approximately 0.6 mm.

Optionally, the primary feed is an L-type single primary feed.

The following describes a construction principle and features of the MHB1 antenna.

(1) The radiating slot 103 is constructed using a metal layer in the display unit of the terminal device, the metal frame, and the boss.

(2) One end of the radiating slot 103 is closed, and the other end is connected to an opening of the second bottom slit on the right side, where the opening may halve a length of the antenna, to become a slot antenna of ¼ wavelength.

(3) A length of the radiating slot 103 may be used to control a resonant frequency of the MHB1 antenna.

(4) A coupling feeding manner is used for the MHB1 antenna, and the primary feed may be an L-shaped single primary feed printed on a PCB. The L-shaped single primary feed may be disposed above or below the slot, and a distance between the L-shaped single primary feed and the boss for forming the radiating slot 103 may be within a range of 0.5 mm to 2 mm.

(5) The L-shaped single primary feed crosses the radiating slot 103. A crossing point may be in the middle of the radiating slot 103, and may extend to the middle of the boss. Radiation is performed using the radiating slot 103, and the MHB1 antenna has a low requirement for clearance. Therefore, a size of the antenna can be reduced.

It should be understood that the boss is designed on the metal middle frame to construct the radiating slot 103, and the boss belongs to a part of the metal middle frame. In this embodiment of this application, to construct the radiating slot 103, the boss may be milled out from the metal middle frame.

It should be further understood that the metal frame may also be milled out from the metal middle frame. As shown in FIG. 1, "inverted L-shape" on the right side is the metal frame, and the metal frame may be milled out from the metal middle frame.

Coupling feeding means that two circuit elements or circuit networks that are not in contact but have a specific short distance in the communications field transfer electric energy in a coupling manner such that one of the elements obtains energy without direct contact with the other element.

According to the MHB1 antenna in this embodiment of this application, the primary feed 102 is connected to a radio frequency (RF) circuit using the feed point 101, and a strong current is generated at a position at which the primary feed 102 crosses the radiating slot 103, the radiating slot is excited in a coupling manner to generate space energy (generate an electric field) such that the radiating slot 103 obtains energy without direct contact with the electric energy.

Optionally, the L-type single primary feed crosses the radiating slot 103 orthogonally.

It should be understood that the antenna 100 in this embodiment of this application may be used as a medium- and high-band antenna in the terminal device. An existing LB antenna may be used as an LB antenna, or an antenna 200 provided in an embodiment of this application may be used as an LB antenna.

Figure 2:
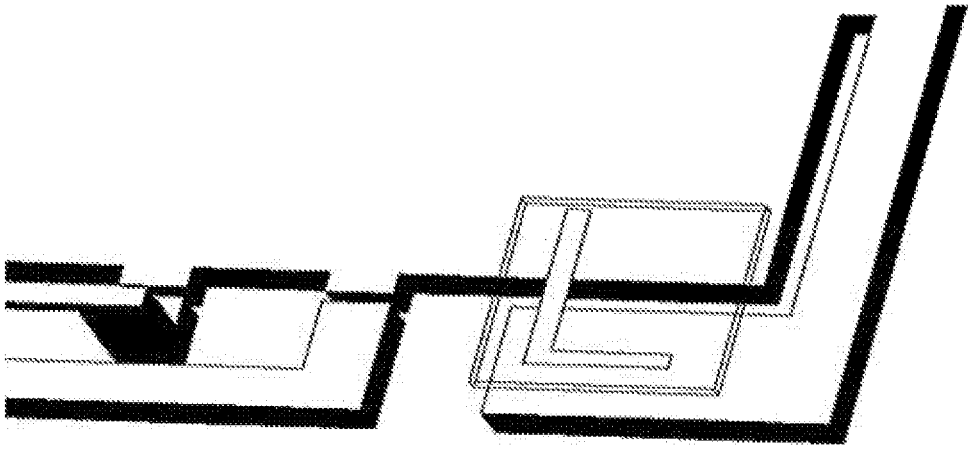
FIG. 2 is a three-dimensional (3D) view of a first medium- and high-band (MHB1) antenna according to an embodiment of this application.

FIG. 2 is a 3D view of an MHB1 antenna according to an embodiment of this application.

A coupled-fed slot antenna in this embodiment of this application can save a connection spring plate from a PCB board to the antenna, help simplify an antenna structure, improve antenna reliability, and reduce costs. In a zero clearance condition, the antenna can also achieve relatively high radiation efficiency. The antenna not only can cover conventional medium and high bands of 1.71 GHz to 2.69 GHz, but also can extend to B32 or B43 (1.45 GHz to 1.50 GHz or 3.4 GHz to 3.8 GHz).

It should be understood that, in this embodiment of this application, a terminal device may include only the MHB1 antenna shown in FIG. 1 or FIG. 2, and an existing LB antenna in the terminal device may be used as a LB antenna of the terminal device.

Figure 3:
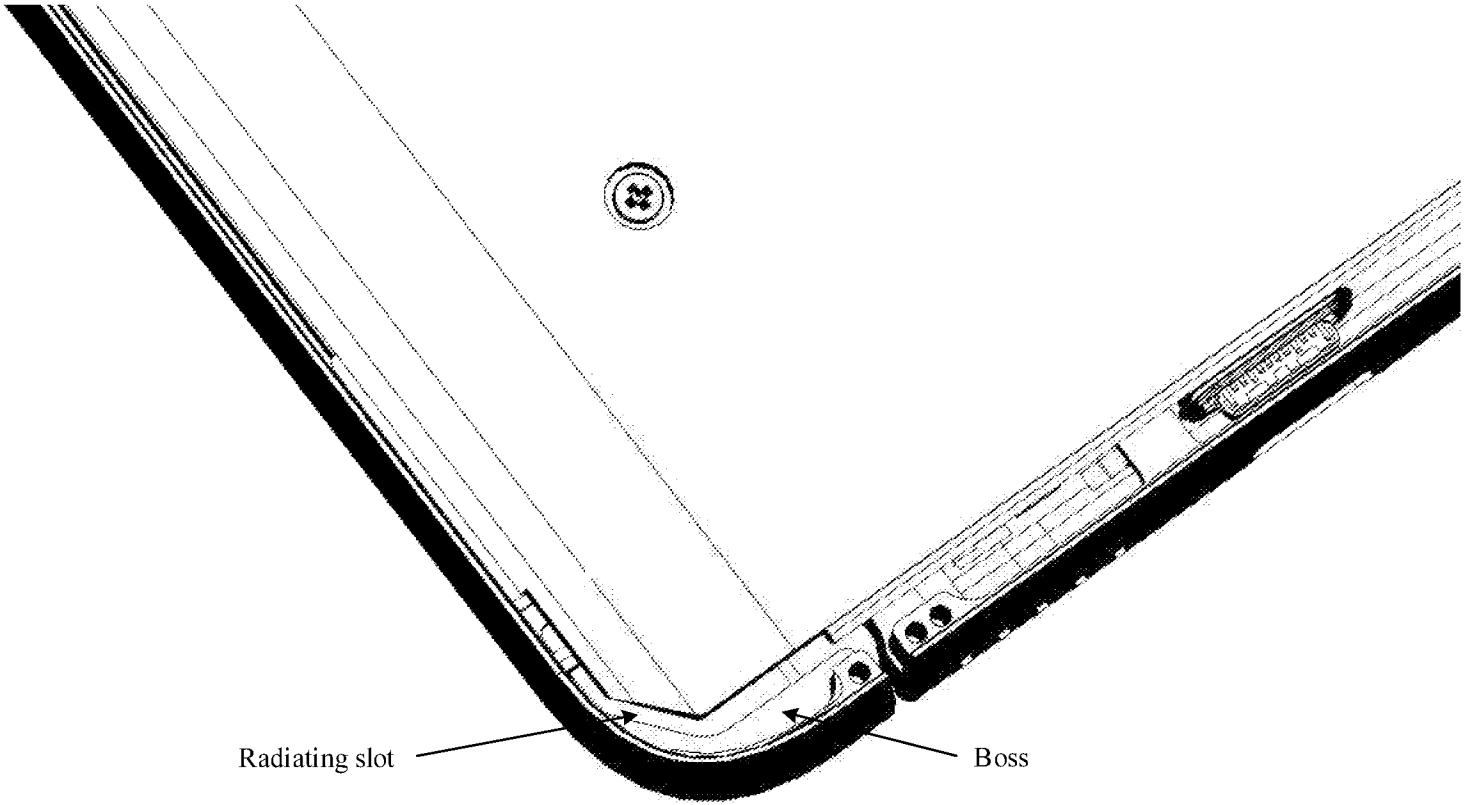
FIG. 3 is a rear view of an MHB1 antenna according to an embodiment of this application.

FIG. 3 is a rear view of a medium- and high-band MHB1 antenna according to an embodiment of this application.

Figure 4:
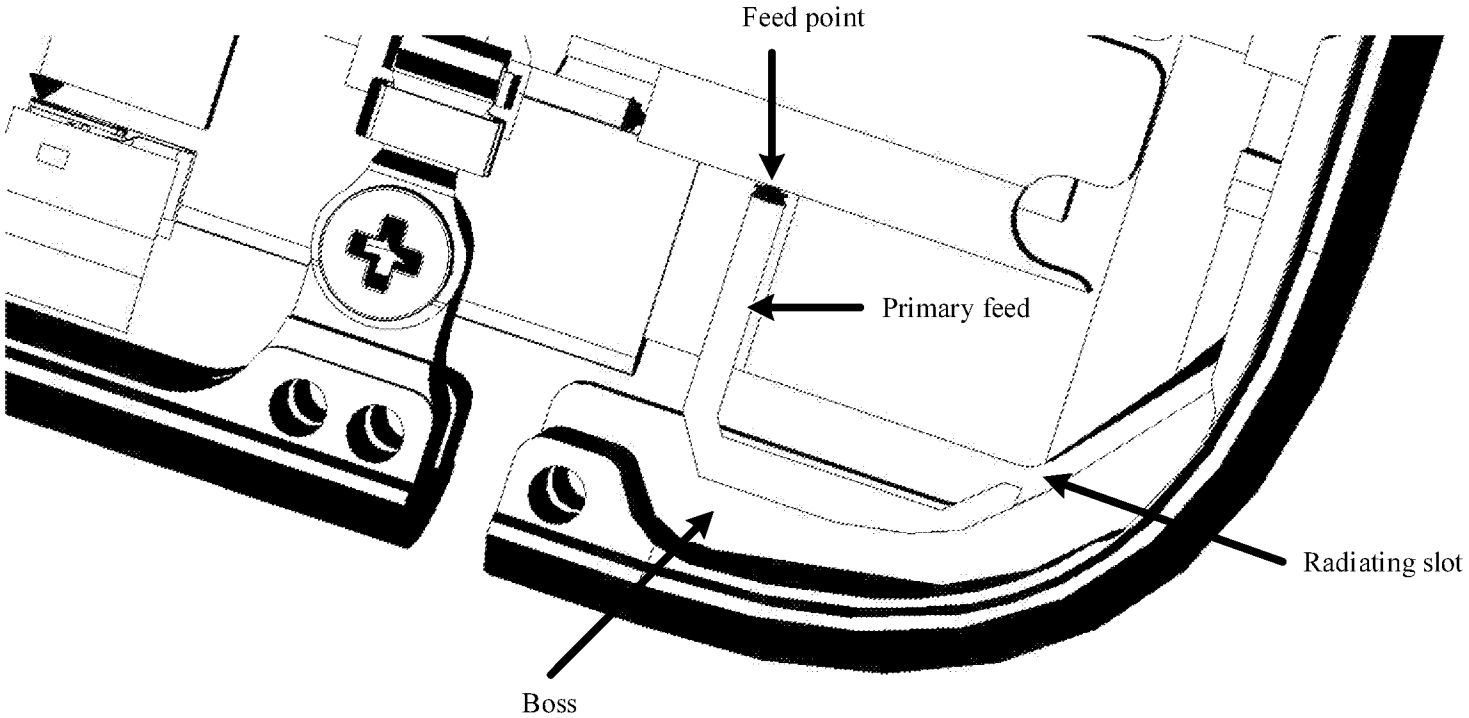
FIG. 4 is a front view of an MHB1 antenna according to an embodiment of this application.

FIG. 4 is a front view of a medium- and high-band MHB1 antenna according to an embodiment of this application.

Figure 5:
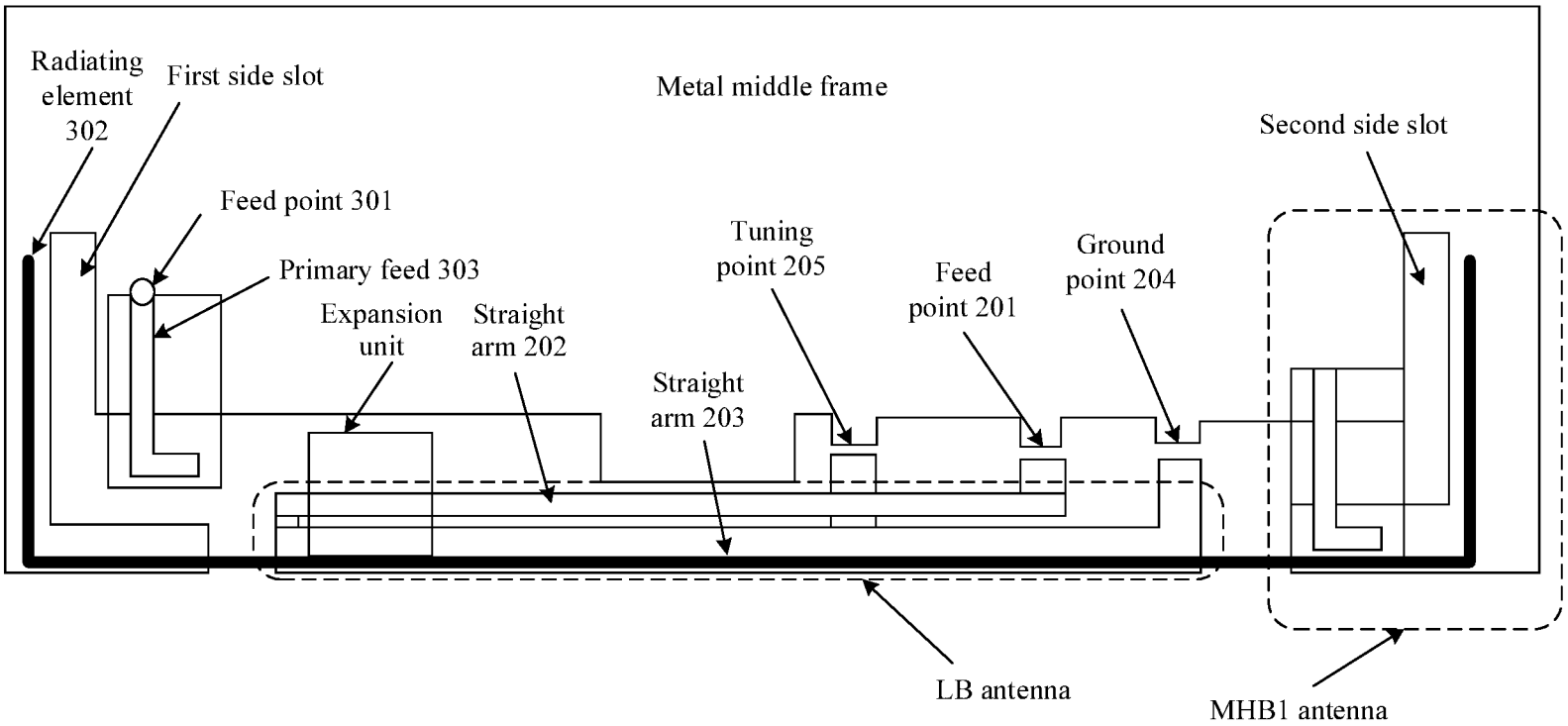
FIG. 5 is another schematic structural diagram of an antenna apparatus according to an embodiment of this application.

With reference to FIG. 1 to FIG. 4, the foregoing describes the MHB1 antenna in this embodiment of this application. Two slits may be opened at a bottom edge of the terminal device, and the two slits divide the metal frame into three segments. In an embodiment, the terminal device may have three independent antenna ports. The antenna shown in FIG. 1 to FIG. 4 may be located on the bottom left side or the bottom right side of the terminal device. With reference to FIG. 5, the following describes an LB and an MHB2 antenna in an embodiment of this application, and the LB antenna may be located in the middle of two bottom slits.

FIG. 5 is another schematic structural diagram of an antenna apparatus according to an embodiment of this application. As shown in FIG. 5, the antenna apparatus may further include an antenna 200. The antenna 200 may be an LB antenna, and the LB antenna is disposed in the middle of the two bottom slits. The LB antenna is designed as an LB tunable antenna, and covers a frequency range of 700 megahertz (MHz) to 960 MHz.

As a main antenna of a terminal device, five tuning states (B28a, B28b, B20, B5, and B8) are designed for the LB antenna. Each tuning state covers a bandwidth of 80 MHz, and the LB antenna is a loop antenna. The loop antenna starts from a feed point 201, is connected to an inner straight arm 202, is bent at a bottom slit on the left side, and returns to a ground point 204 of the antenna 200 passing through an outer straight arm 203.

Optionally, the antenna 200 further includes a tuning point 205, and the tuning point 205 is located on the left side of the feed point 201, and the ground point 204 is located on the right side of the feed point 201.

The following describes a construction principle and features of the LB antenna.

(1) A radiating element of the LB antenna is placed between the two bottom slits, and a length of the LB antenna is very short. Generally, the length is 40 mm to 46 mm, and is about 25 mm shorter than that of a T antenna.

(2) Shortening of the radiating element of the LB antenna also causes a relatively high initial resonant frequency. A solution is to expand an area of the antenna at bending of the LB antenna, for example, add an expansion unit. Adding the expansion unit is equivalent to loading a capacitor at the end of the antenna to reduce the initial resonant frequency of the antenna.

(3) This structure may form a zero point of a current at a bend point of the LB antenna, and the straight arm 202 and the straight arm 203 form two overlapping dipoles. A bandwidth of the LB antenna can be increased by 10% to 15% due to a slight difference between electric lengths.

(4) Because the LB antenna has an independent port, a band-stop matching circuit may be designed at the feed point 201 of the LB antenna. The band-stop matching circuit can isolate interference from an MHB1 antenna to the LB antenna.

It should be understood that, in this embodiment of this application, a width direction of the terminal device may be defined as an X direction, a length direction may be defined as a Y direction, and a thickness direction may be defined as a Z direction. Both the straight arm 202 and the straight arm 203 may be located in a plane parallel to the Z direction, and the two straight arms may be staggered by a specific angle or overlap. In this way, a length requirement of the straight arms for the Y direction can be reduced.

Optionally, the expansion unit is a metal sheet.

Optionally, an area of the metal sheet is from 7 mm×5 mm to 15 mm×7 mm. FIG. 5 further shows a schematic structural diagram of an antenna 300 in the antenna apparatus according to this embodiment of this application. As shown in FIG. 5, the antenna 300 may be an MHB2 antenna. The medium- and high-band antenna may be located on the bottom left side of the terminal device, and may be used as a medium- and high-band MIMO antenna of the terminal device. A radiating element of the MHB2 antenna is a special ½-wavelength U-shaped loop antenna, and a resonance point of the antenna may be within a range of 1.8 GHz to 2.0 GHz. The antenna 300 includes a feed point 301 and a radiating element 302. The radiating element 302 starts from a ground point of a first side slot on the left side, passes through a metal frame ("L-shaped") on the left side and crosses a first bottom slit on the left side, reaches the straight arm 203, reaches a metal frame ("inverted L-shaped") on the right side after crossing a second bottom slit, and is finally grounded at a ground point of a second side slot on the right side.

In the MHB2 antenna in this embodiment of this application, the feed point may excite the radiating element in a direct feeding manner and a coupling feeding manner.

When the direct current feeding manner is used, the third feed point 301 may be disposed on the metal frame ("L-shaped") on the left side.

Optionally, the MHB2 antenna further includes a second primary feed 303, the second primary feed 303 is located on a sound box of the terminal device, and the second primary feed 303 is connected to the third feed point 301.

It should be further understood that, in the MHB2 antenna shown in FIG. 5, the radiating element 302 is excited in the coupling feeding manner.

The third feed point 301 may be connected to the second primary feed 303, and the second primary feed 303 is coupled to the radiating unit 302.

It should be understood that because a width of the bottom slit is relatively narrow, electrical energy on the metal frame on the left side is transferred to the straight arm 203 in the coupling manner.

It should be further understood that a length of the side slot affects a length of the loop antenna.

It should be further understood that a side of the MHB1 antenna and the radiating element (the straight arm 203) of the LB antenna are used for the radiating element 302.

The following describes a construction principle and features of the MHB2 antenna.

(1) The MHB2 antenna uses some structures of the LB antenna and the MHB1 antenna, and the loop antenna crosses the two bottom slits, to constitute a symmetric U-shaped loop antenna.

(2) The MHB2 antenna extends the length of the loop antenna using slots on the left side and the right side. In addition, a length of the slot can also be used to control the initial resonant frequency.

(3) A primary feed of the MHB2 antenna is placed on the sound box and is an L-shaped dipole. A current on a U-shaped loop antenna is excited in a coupling feeding manner.

(4) In addition to large-loop radiation, a connection point (the feed point 201 or the ground point 204) of the LB antenna may be further used to obtain another small loop current, or a current of ¾ wavelength. In this way, a bandwidth of the MHB2 antenna is increased. A design feature of this antenna is that the MHB2 antenna repeatedly uses some radiating elements of the LB antenna and the MHB1 antenna, to construct a third independent antenna.

It should be understood that, in a design solution of the MHB2 antenna, there is no limitation on a PCB board on the bottom left side of the terminal device. If there is a PCB board on the left side, the MHB2 antenna may alternatively be implemented using a method for implementing the MHB1 antenna.

It should be further understood that the MHB2 antenna is a coupled-fed antenna, and may alternatively be implemented using a direct feeding manner.

It should be further understood that the band-stop matching circuit of the feed point 201 may further isolate interference from the MHB1 antenna and the MHB2 antenna to the LB antenna.

It should be further understood that a future 5G system needs a plurality of medium- and high-band antennas, for example, four antennas. The plurality of medium- and high-band antennas need to coexist, but do not interfere with each other. In the past, only one LB antenna and one medium- and high-band antenna can be disposed at the bottom. Currently, one LB antenna and two medium- and high-band antennas are disposed in a same environment.

Optionally, the terminal device further includes a capacitor 400, and the capacitor 400 is located between the ground point of the LB antenna and a feed point of the MHB1 antenna.

Because the terminal device includes two coexisting medium- and high-band (MHB1 and MHB2) antennas, and mutual interference exists between same-band antennas, a tunable capacitor 400 may be loaded between the ground point of the LB antenna and the feed point of the MHB1 antenna.

Optionally, the capacitor 400 is a tunable decoupling capacitor.

In this embodiment of this application, the tunable capacitor is loaded between the ground point of the LB antenna and the feed point of the medium- and high-band antenna, to help improve an isolation degree between the two medium- and high-band antennas. The capacitor has another function, in an embodiment, single-state radiation efficiency of the MHB1 antenna can be improved by tuning a capacitance value of the capacitor.

Figure 6:
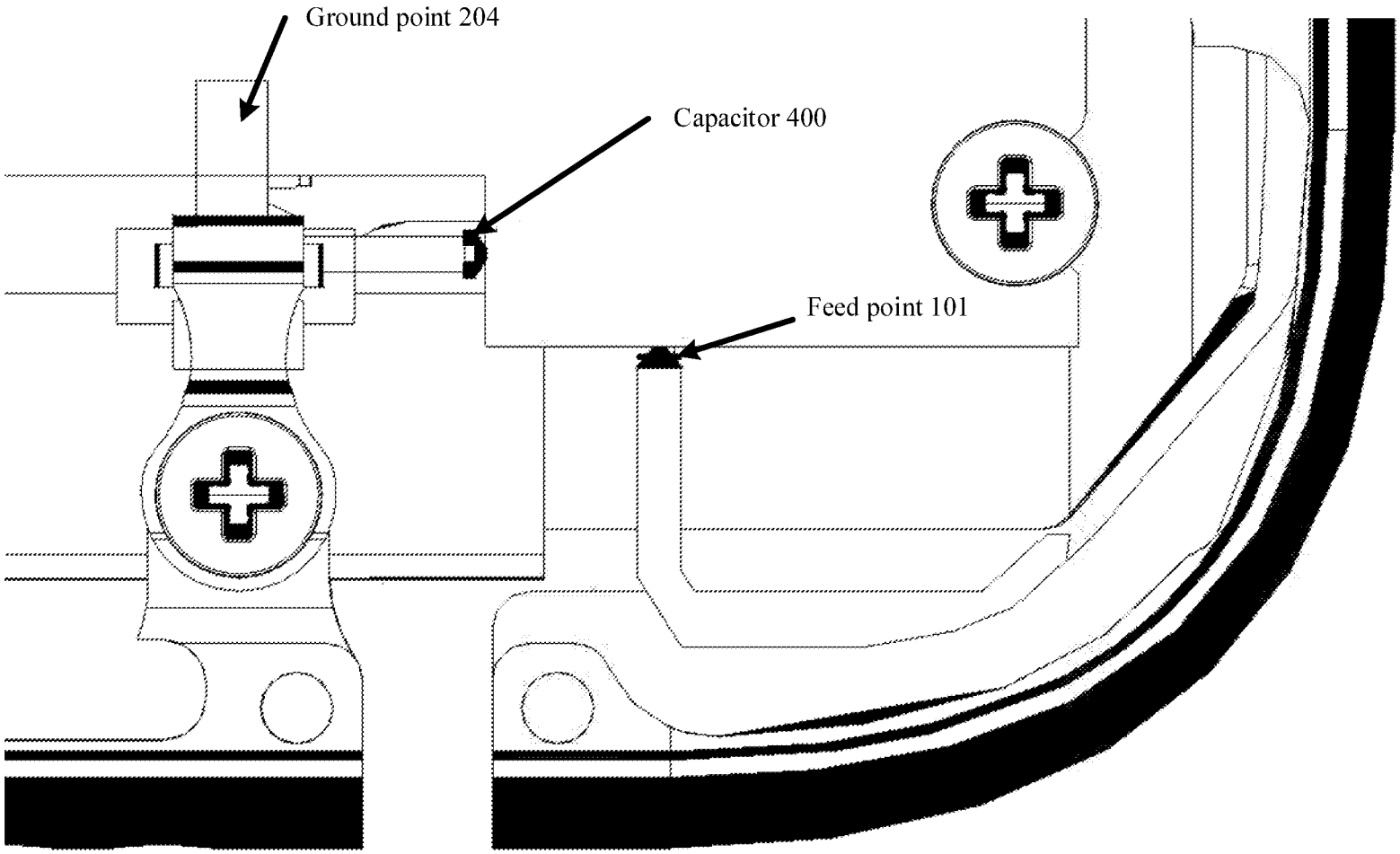
FIG. 6 is a schematic diagram of a capacitor used to improve an isolation degree between an MHB1 antenna and a second medium- and high-band (MHB2) antenna according to an embodiment of this application.

FIG. 6 is a schematic diagram of a capacitor 400 used to improve an isolation degree between an MHB1 antenna and an MHB2 antenna according to an embodiment of this application. As shown in FIG. 6, the capacitor 400 is located between a ground point 204 of an LB antenna and a feed point 101 of the MHB1 antenna, and can improve the isolation degree between the MHB1 antenna and the MHB2 antenna.

Figure 7:
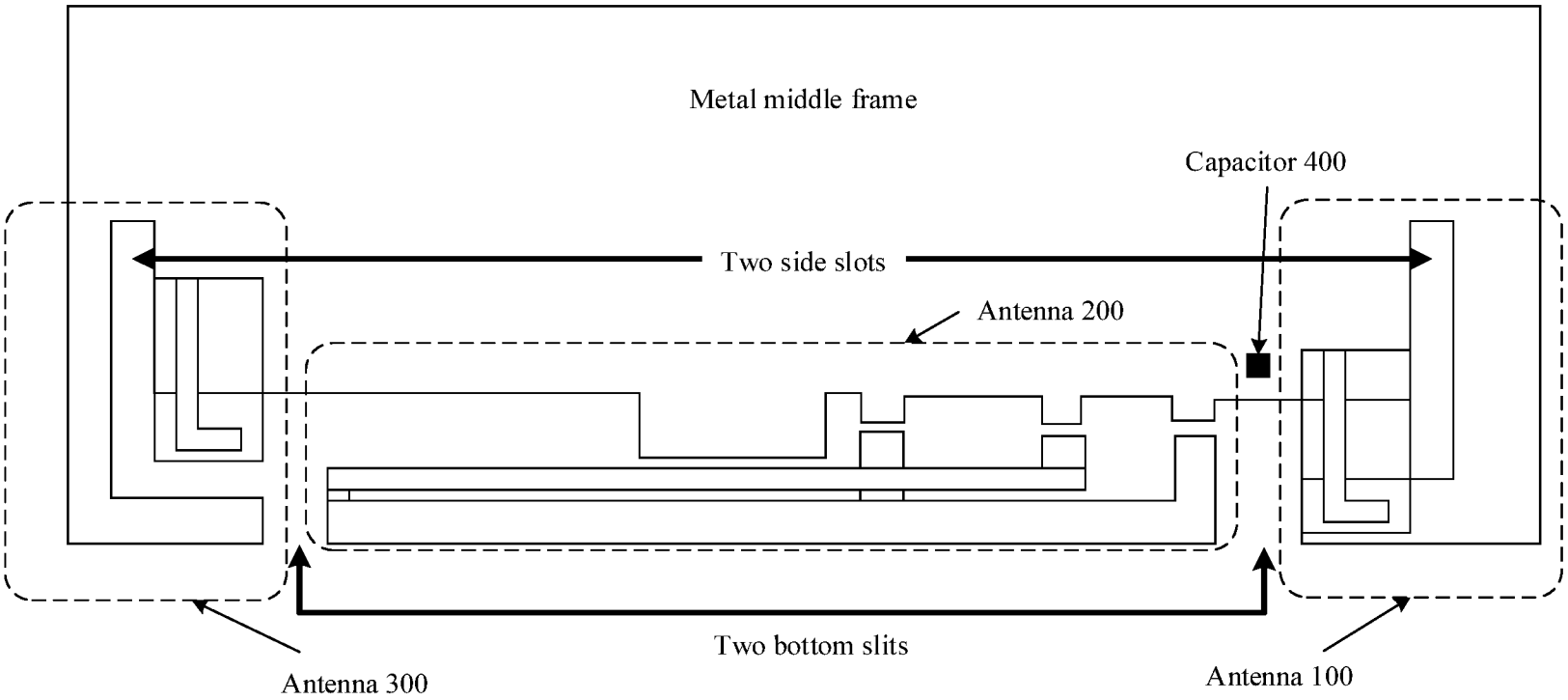
FIG. 7 is a still another schematic structural diagram of an antenna apparatus according to an embodiment of this application.

FIG. 7 is still another schematic structural diagram of an antenna apparatus according to an embodiment of this application. FIG. 7 shows three antennas (an MHB1 antenna, an LB antenna, and an MHB2 antenna) designed at the bottom of a terminal device.

It should be understood that a medium- and high-band antenna in the terminal device in this embodiment of this application may be the MHB1 antenna shown in FIG. 1 to FIG. 4, and an LB antenna may be an existing LB antenna.

It should be further understood that antennas of the terminal device in this embodiment of this application may include only the MHB1 antenna shown in FIG. 1 to FIG. 4 and the LB antenna shown in FIG. 5.

It should be further understood that locations of the MHB1 antenna and the MHB2 antenna may be interchanged.

It should be further understood that if a feed point of the LB antenna is a first port, a feed point of the MHB1 antenna is a second port, and a feed point of the MHB2 antenna is a third port, an architecture of the three antenna ports may be located not only at the bottom of the terminal device, but also at the top and on a side of the terminal device. This is not limited in this application.

With reference to FIG. 8 to FIG. 24, the following describes simulation and test results of antenna performance in the embodiments of this application. An example of the simulation and a test is based on a mobile phone A and a mobile phone B of an antenna research project of XX company. Dimensions of the mobile phone A and the mobile phone B are 5.2 inches and 5.5 inches, respectively. Clearance of an antenna at the bottom of the mobile phone A is 3.8 mm, and dimensions of the mobile phone A are 149.1 mm×70.9 mm. Clearance of an antenna at the bottom of mobile phone B is 2 mm, and dimensions of the mobile phone B are 152.3 mm×74.5 mm.

Figure 8:
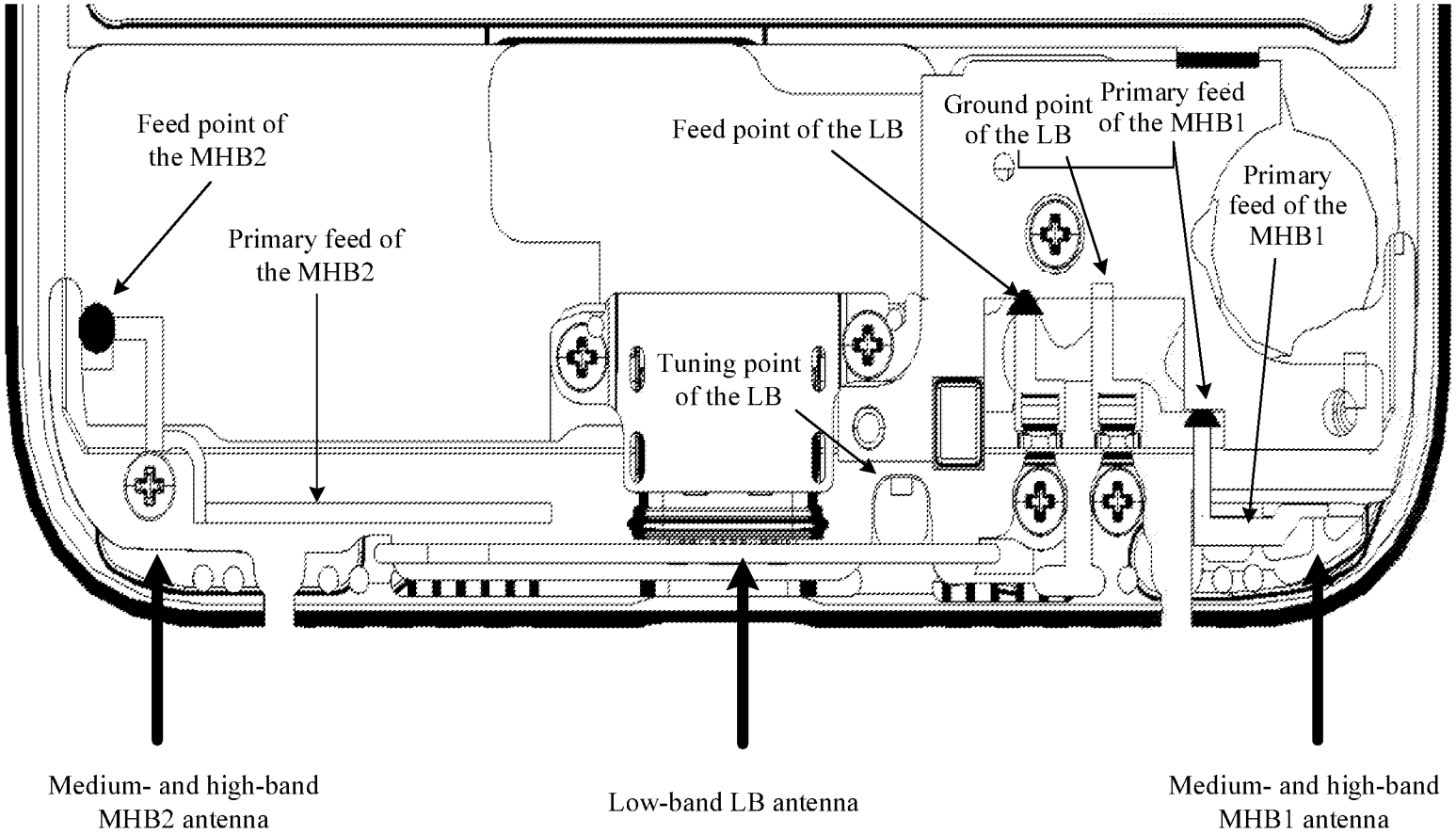
FIG. 8 is a schematic structural diagram of three independent antennas of a test mobile phone A according to an embodiment of this application.

FIG. 8 is a schematic structural diagram of three independent antennas of a mobile phone A. An LB antenna is located in the middle of the bottom of the mobile phone A. The antenna starts from a feed point, passes through a bridge inside a metal loop, and is bent at a slot on the left side to a ground point of the LB antenna. A switch of a single-pole five-throw (SPST) is configured at a tuning point of the LB antenna, and may be connected to five different loads. In this way, the antenna can cover 700 MHz to 960 MHz.

Figure 9:
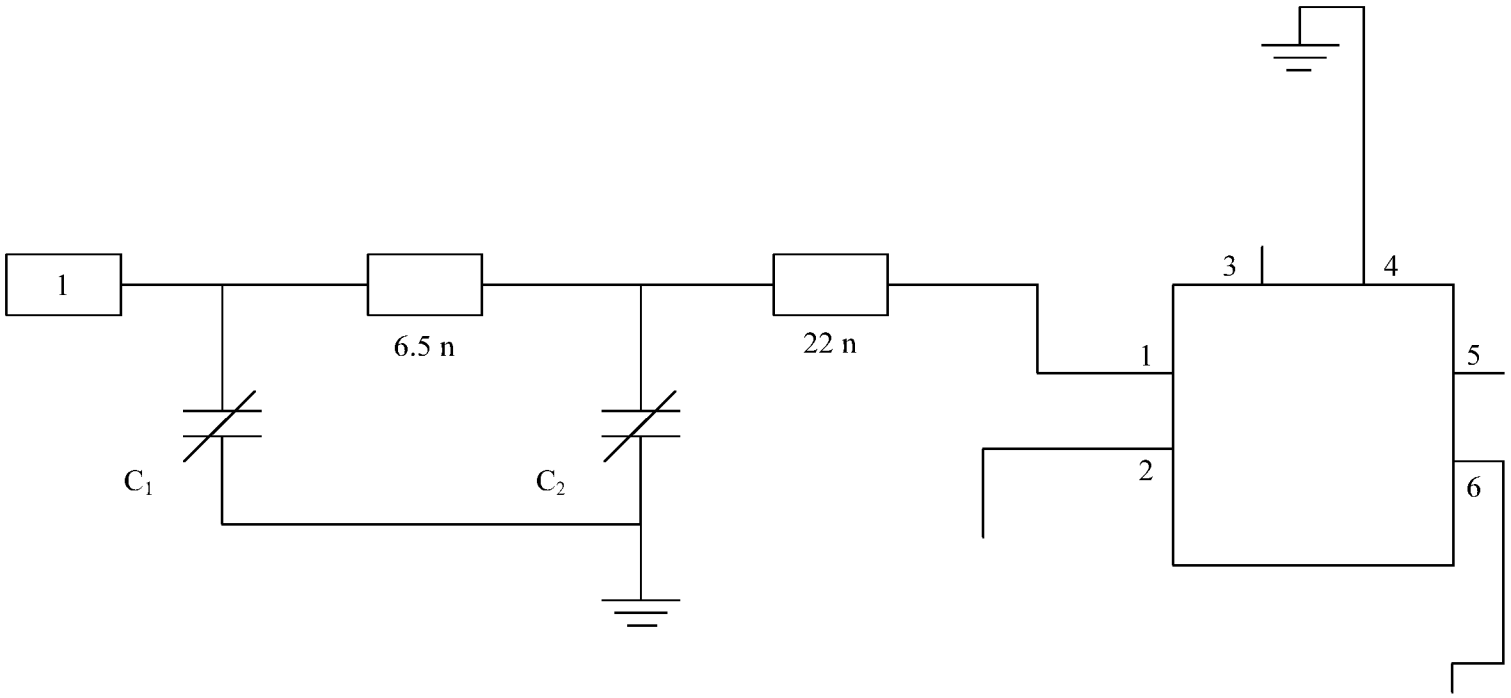
FIG. 9 is a schematic diagram of a matching circuit of a feed point of an LB antenna.

FIG. 9 is a schematic diagram of a matching circuit of a feed point of an LB antenna. A topology of the matching circuit of the feed point is a series inductor, a parallel capacitor, a series inductor, and a parallel capacitor (SLPC). This matching circuit has two functions (1) in each tuning state, the matching circuit generates a double resonance at a low frequency, and (2) the matching circuit is a band-stop filter at medium and high bands.

Two ground capacitors C1 and C2 in the matching circuit are tunable, and need to adapt to a change of a SPST switch at a tuning point. When impedance of the switch is switched from open circuit, 80 nanohenries (nH), 20 nH, 12 nH to 5.6 nH, a ground capacitor of the feed point is also tuned from high to low. Table 1 is a table of true values in five tuning states, namely, B28a, B28b, B20, B5 and B8.

TABLE 1

True values in five tuning states

| A frequency tuning of an LB (MHz) | C1 (picofarads (pf)) | C2 (pf) | Impedance from a tuning point to the ground |
|---|---|---|---|
| 703 to 783 (B28a) | 17 | 13 | Open circuit |
| 723 to 803 (B28b) | 16.5 | 12.5 | 80 nH |
| 790 to 870 (B20) | 15 | 12 | 20 nH |
| 820 to 900 (B5) | 13 | 10.5 | 12 nH |
| 880 to 960 (B8) | 10 | 8.5 | 5.6 nH |

Figure 10:
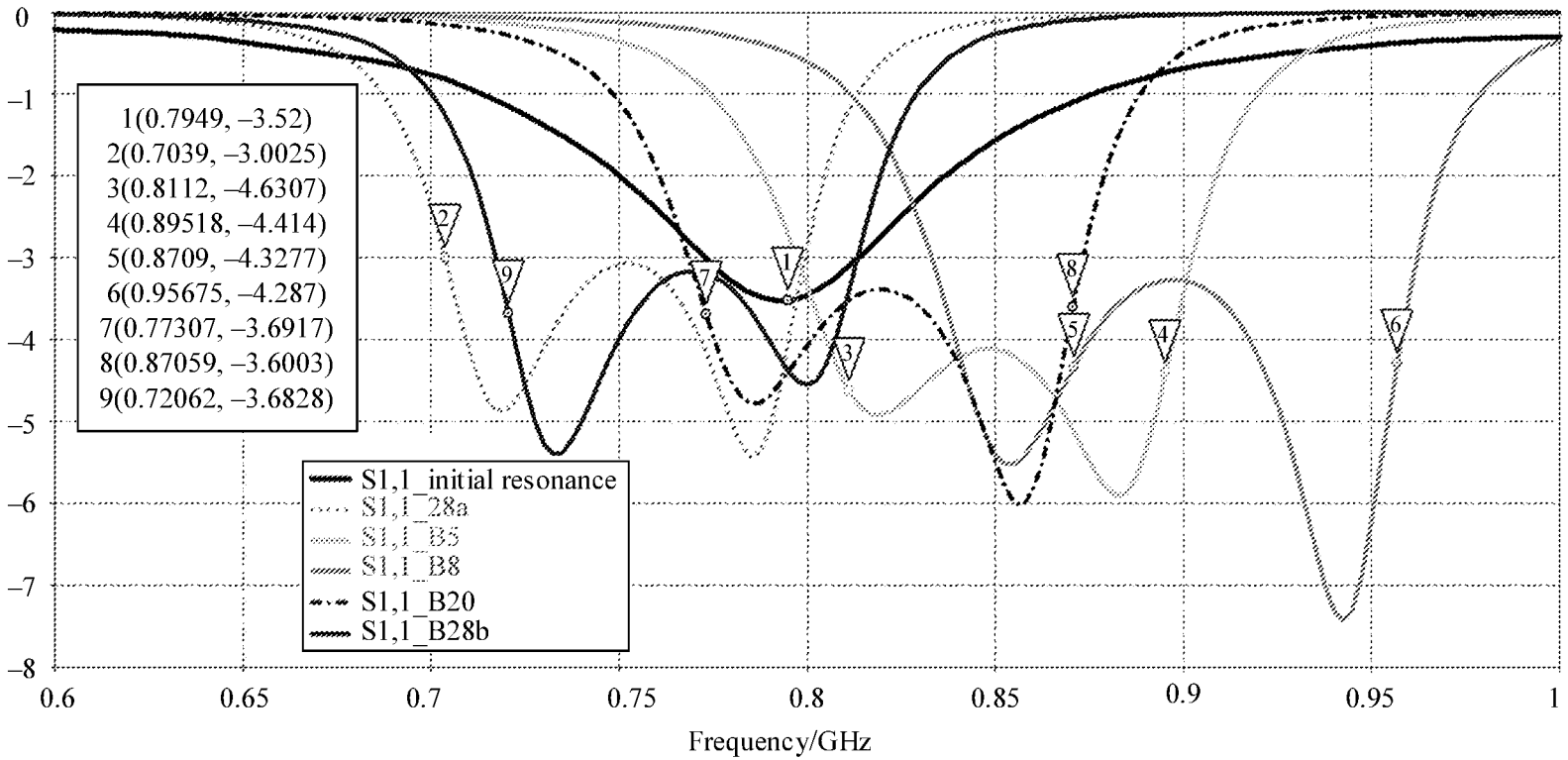
FIG. 10 shows a reflection coefficient S11 curve of an LB antenna in five tuning states.

FIG. 10 shows a reflection coefficient S11 curve of an LB antenna in five tuning states. The five tuning states present better double resonance. An initial resonant frequency of a LB antenna is designed to be 792 MHz. Tuning from a low band to a high band is relatively easy to implement.

Figure 11:
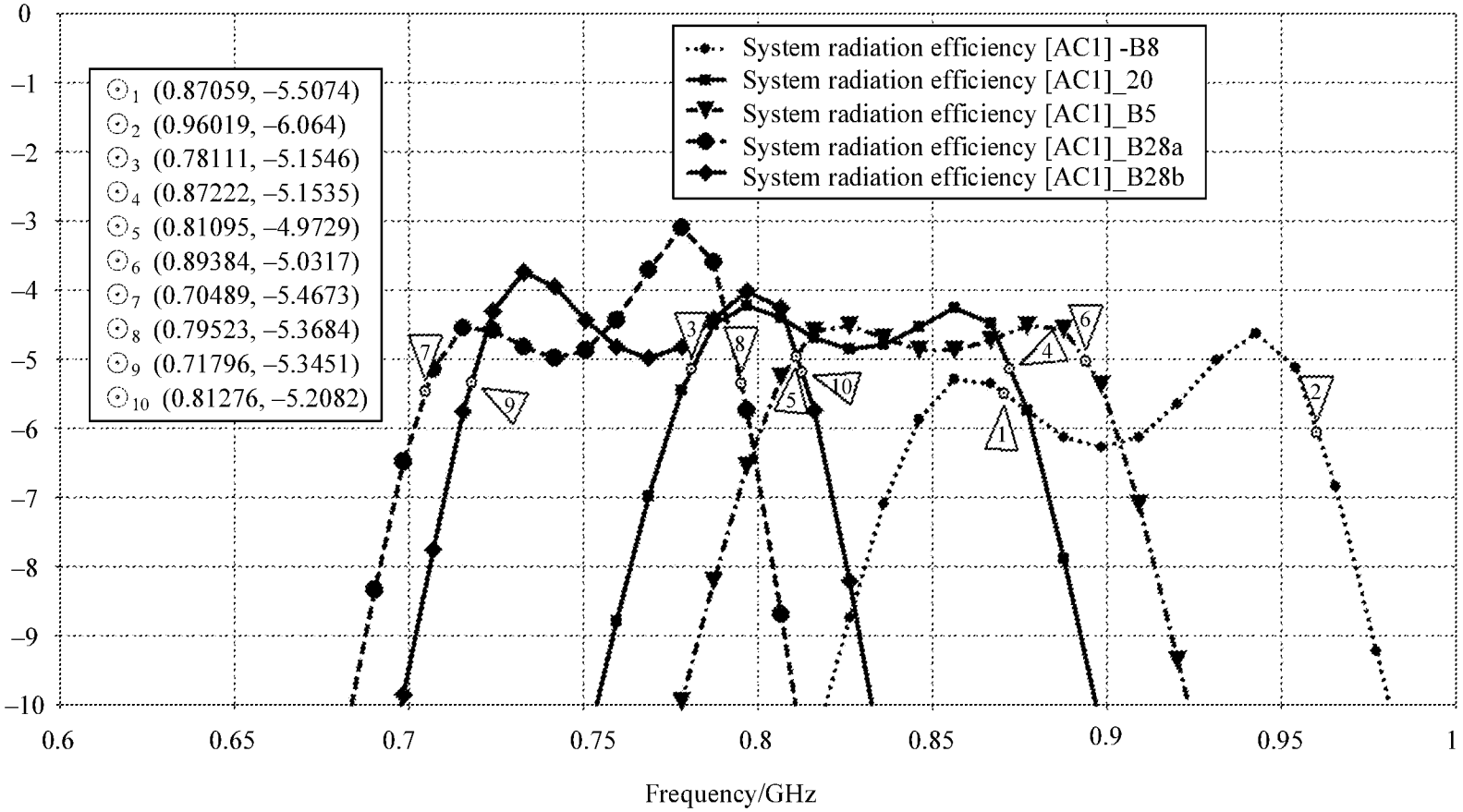
FIG. 11 shows a radiation efficiency curve of an LB antenna in five tuning states.

FIG. 11 shows a radiation efficiency curve of an LB antenna in five tuning states. Every 80 MHz is used as a tuning step, and two peaks of efficiency are presented. For a transmitter (Tx) in B28a, B28b, B20, B5, and B8 states, average radiation efficiency can reach −5 decibels (dB), and for a receiver (Rx), radiation efficiency in a B8 state decreases by 0.5 dB.

Figure 12:
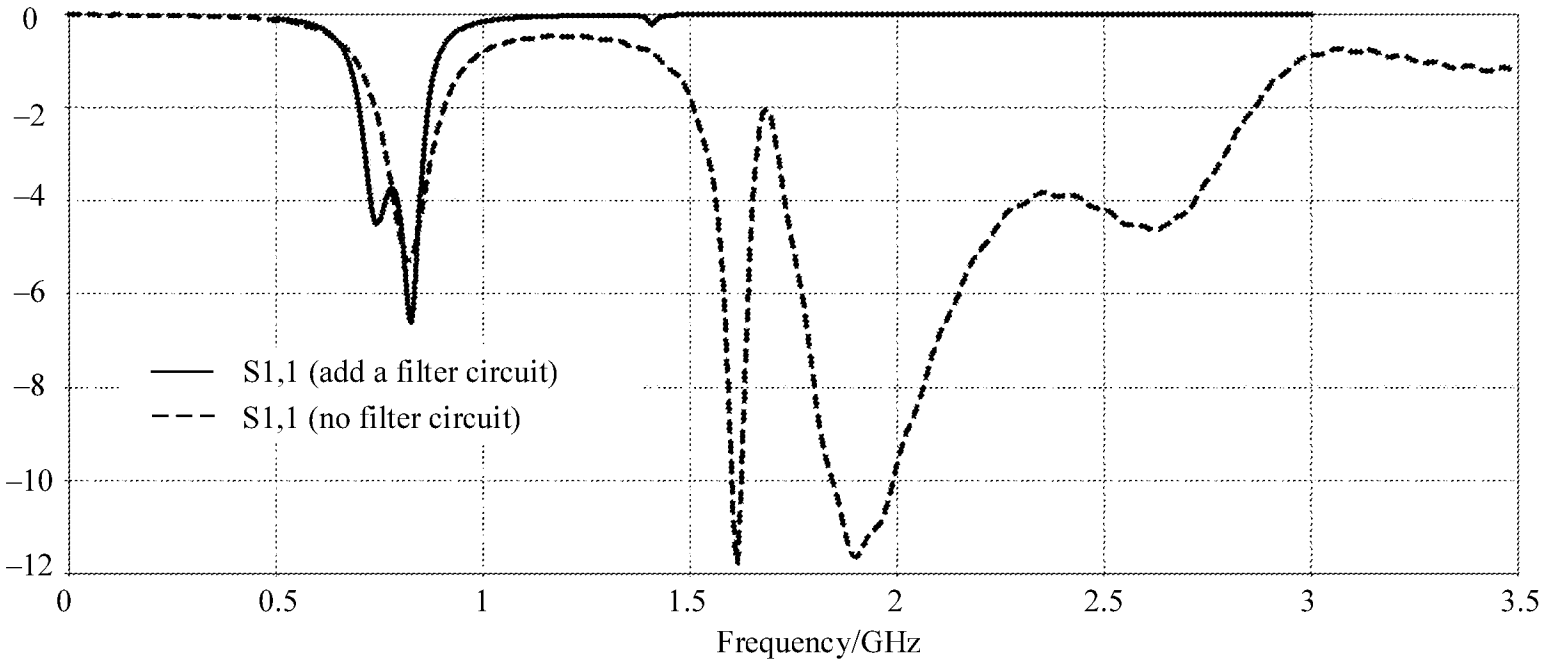
FIG. 12 shows a curve of a filtering effect of a matching circuit of an LB antenna on a medium- and high-band antenna.

FIG. 12 shows a curve of a filtering effect of a matching circuit of an LB antenna on a medium- and high-band antenna. As shown in FIG. 12, after being filtered, the two medium- and high-band antennas do not interfere with the LB antenna.

Current distribution of the LB antenna is as follows at a slot on the left side, that is, a bend point of the LB antenna, a zero point (a strong radiation point) of a current is formed. In this scenario, a metal loop (a straight arm 203) and a bridge (a straight arm 202) have codirectional currents. The metal loop and the bridge resemble two overlapping dipoles. This is one of the reasons why the LB antenna has a broadband feature.

Figure 13:
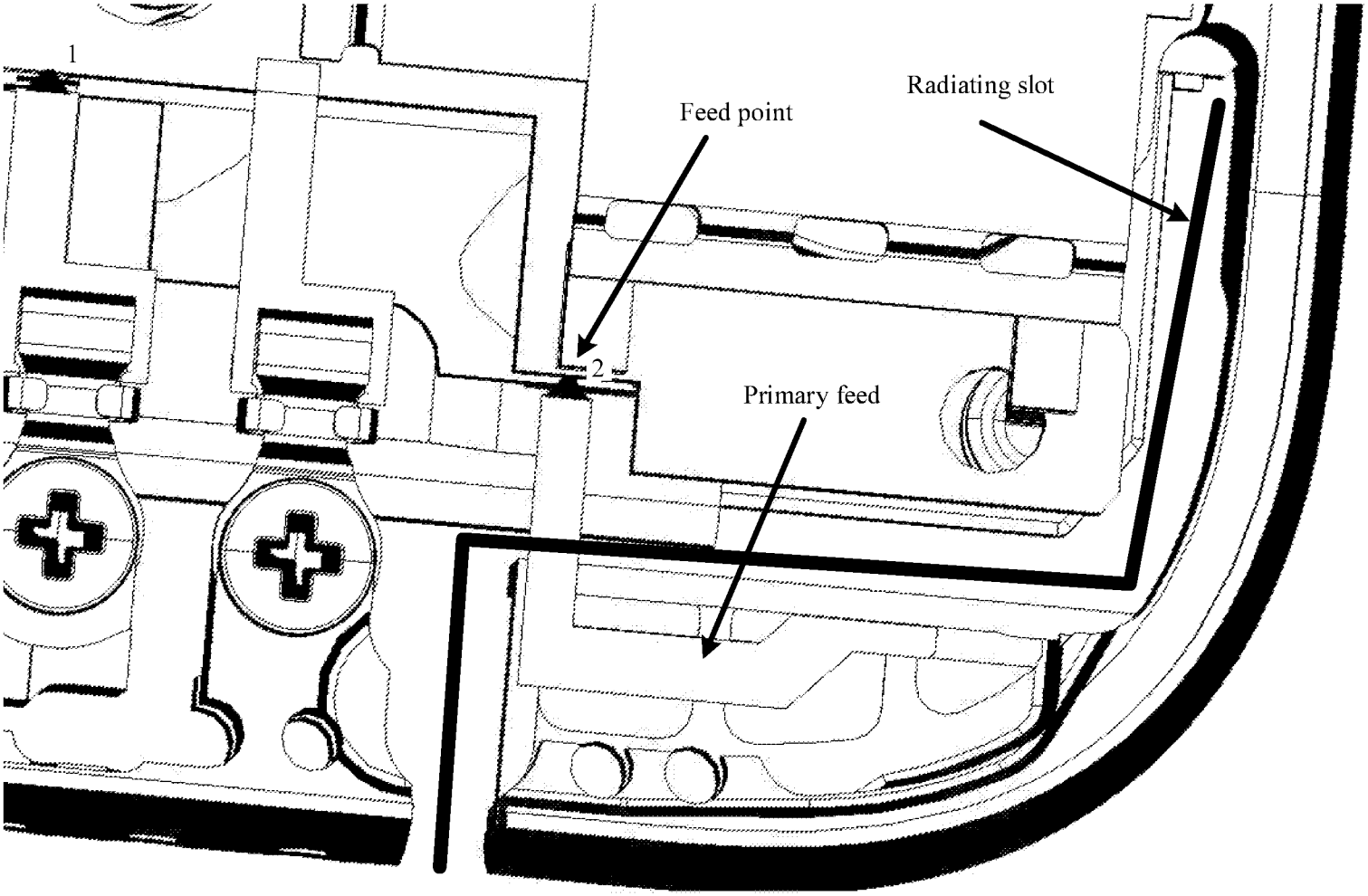
FIG. 13 is a schematic structural diagram of an MHB1 antenna.

FIG. 13 is a schematic structural diagram of an MHB1 antenna. The MHB1 antenna is designed as a main antenna of medium- and high-band antennas. The MHB1 antenna is a slot-coupled antenna, and a black line in the figure is a radiating slot of the antenna. A monopole is a primary feed coupling unit, and is a microstrip printed on a PCB board. A distance between a boss and the radiating slot is about 0.8 mm, the monopole can cross the slot orthogonally, and an electric field (a magnetic current) in the slot is excited in a coupling manner. In this way, a resonance is generated near 1.8 GHz. Another high-band resonance may be obtained using a straight arm 203 of an LB antenna, to form a broadband antenna.

Figure 14:
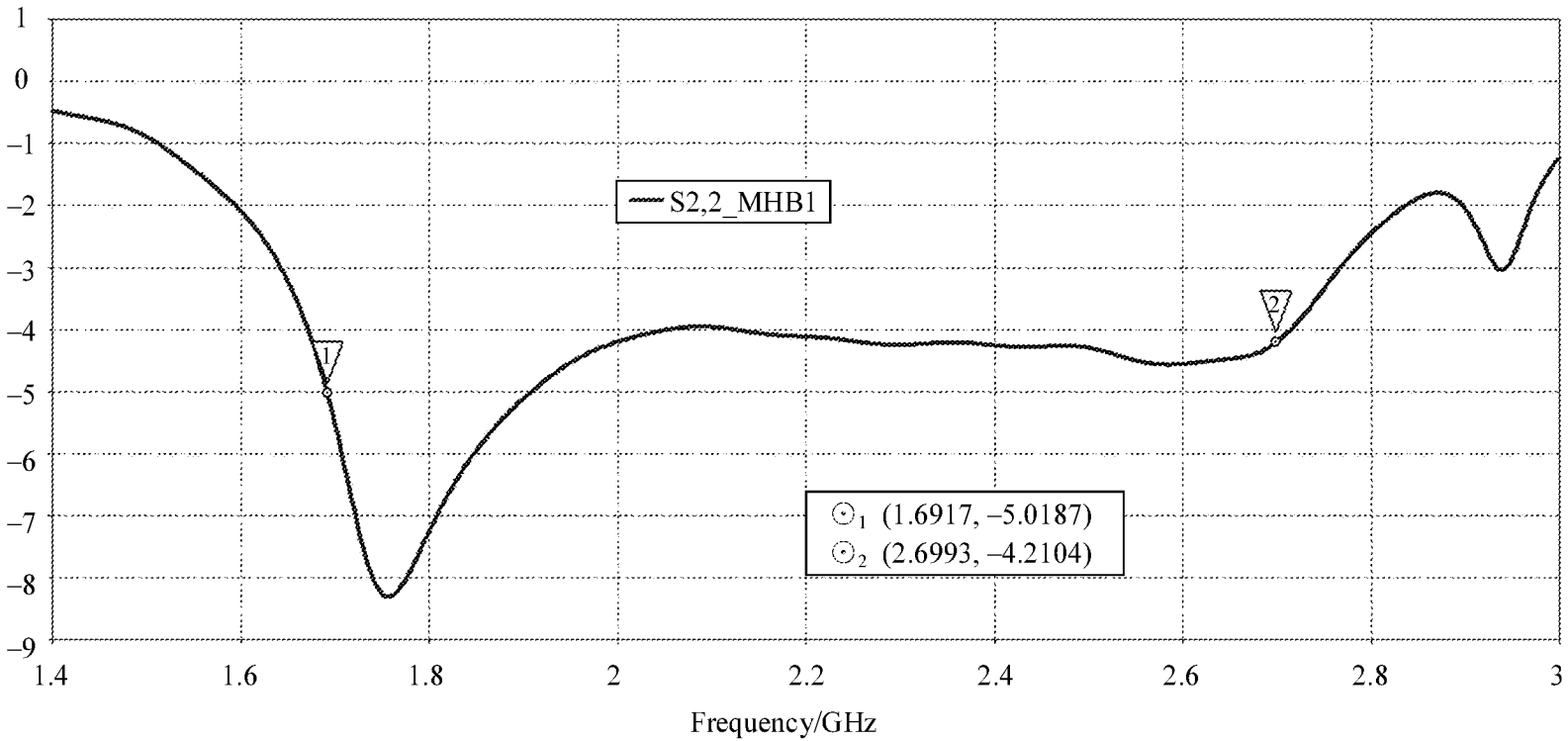
FIG. 14 shows a reflection coefficient S11 curve after an MHB1 antenna is matched.

FIG. 14 shows a reflection coefficient S11 curve after an MHB1 antenna is matched.

Figure 15:
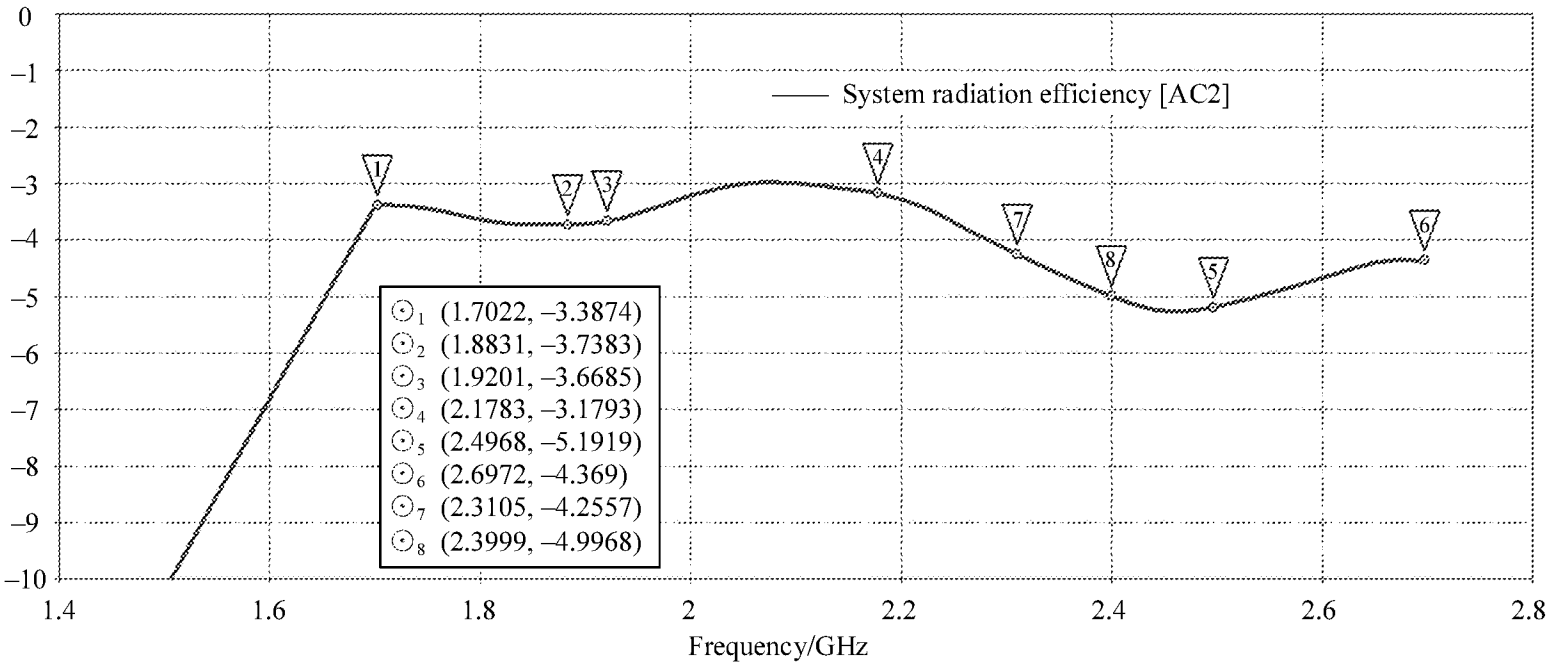
FIG. 15 shows a radiation efficiency curve of an MHB1 antenna.

FIG. 15 shows a radiation efficiency curve of an MHB1 antenna. As shown in FIG. 15, average radiation efficiency of the antenna in bands of 1.7 GHz to 2.2 GHz is higher than −3.5 dB, and radiation efficiency of the antenna in bands of 2.3 GHz to 2.7 GHz is higher than −4.5 dB.

Figure 16:
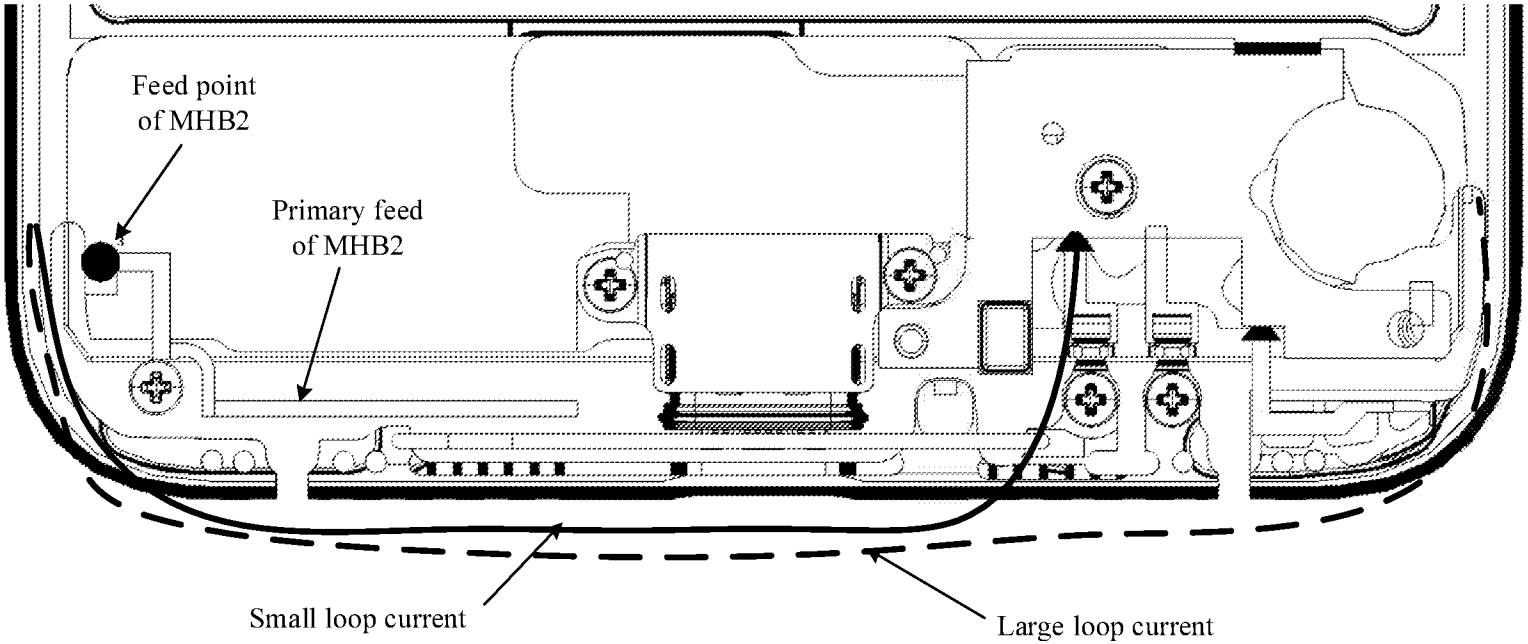
FIG. 16 is a schematic structural diagram of an MHB2 antenna.

FIG. 16 is a schematic structural diagram of an MHB2 antenna. The MHB2 antenna is designed as an auxiliary antenna, and covers 1.805 GHz to 2.69 GHz. A primary feed of the MHB2 antenna is a dipole antenna, and cannot generate resonance and effective radiation because the primary feed is shielded by a metal loop. However, at a secondary radiating element of the MHB2 antenna, that is, a U-shaped loop at the bottom, two loop currents are generated through excitation. One is a symmetrical large loop current, a current inversion point of the symmetrical large loop current can be observed at a Universal Serial Bus (USB) interface of the phone, and is marked by a dashed line in FIG. 16. The other is a small loop (or ¾ wavelength) current, is grounded from a side slot on the left side to a feed point of an LB antenna, and is marked by a solid line in FIG. 16. Because the antenna has two resonances that are respectively near 1.8 GHz and 2.1 GHz, it is easy to obtain broadband matching.

It should be understood that, at the USB interface of the phone of a terminal device, the large loop current is a zero current of the large loop current, but radiation is strong. A ground point of the side slot of a metal middle frame is a strong current point, but radiation is low. When a current passes through two bottom slits on a metal frame, a principle of coupling feeding is also used. Because a length of the bottom slit is not large, the coupling feeding may be used to continue to transmit electric energy to metal frames on two sides.

Figure 17:
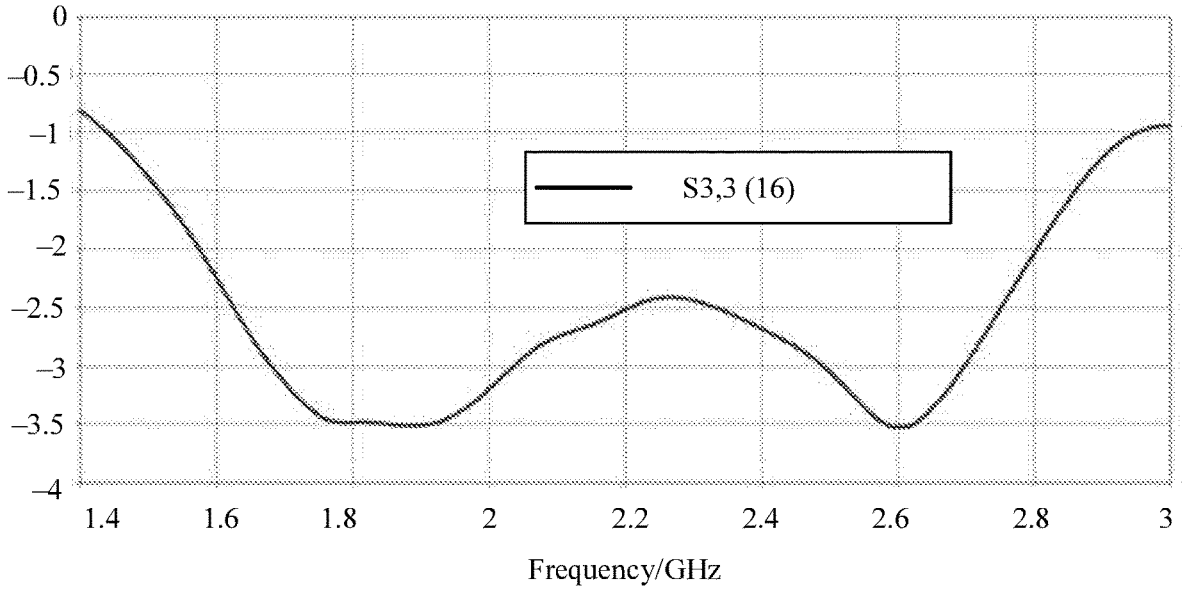
FIG. 17 shows an S parameter curve after MHB2 antenna is matched.

FIG. 17 shows an S parameter curve after MHB2 antenna is matched.

Figure 18:
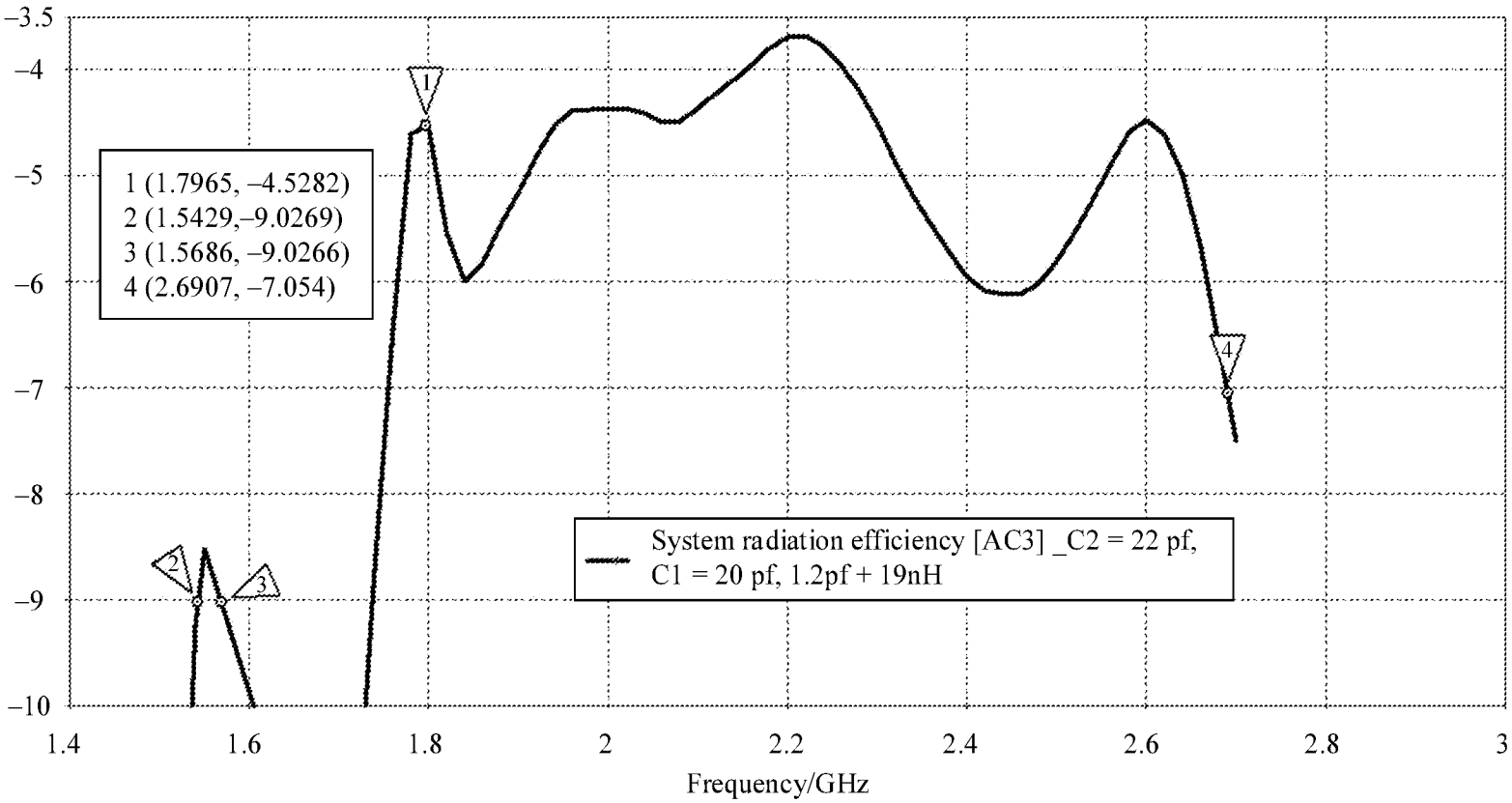
FIG. 18 shows a radiation efficiency curve of an MHB2 antenna.

FIG. 18 shows a radiation efficiency curve of an MHB2 antenna, average efficiency in a B7 state is −6.5 dB. Average efficiency in other bands can reach −5.0 dB to −5.5 dB. It can be found that the MHB2 antenna also has an efficiency peak (slightly high) in a B32 state.

Figure 19:
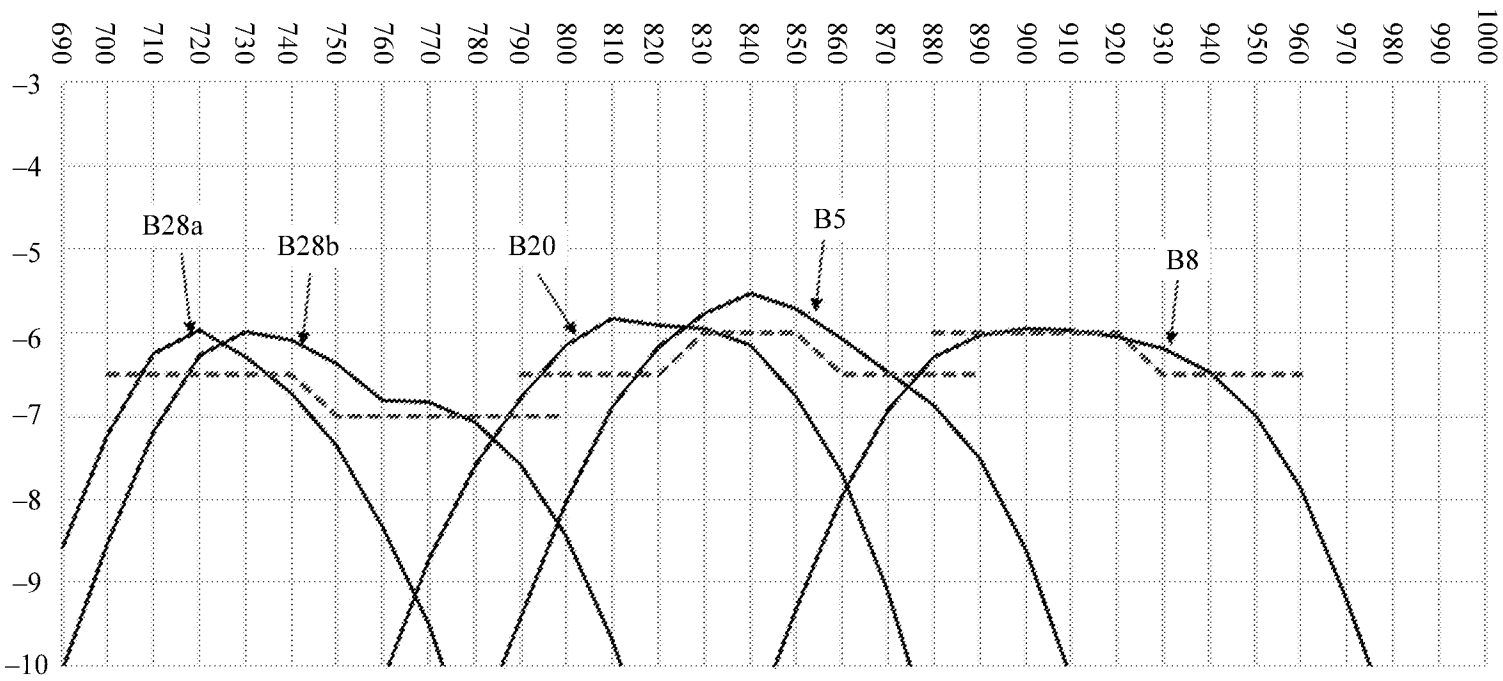
FIG. 19 shows a radiation efficiency curve of an LB antenna in a test mobile phone B in five tuning states according to an embodiment of this application.

In a test on a mobile phone B, losses of upper and lower glass, a switch, a tunable capacitor, and a cable are all included. FIG. 19 shows a radiation efficiency curve of an LB antenna in a mobile phone B in five tuning states. For an Rx at a band edge of a B8 state, efficiency decreases to −7.5 dB, and average efficiency may reach −7 dB. In a B28a state, efficiency needs to be shifted to a low band by 10 MHz, and average efficiency of a Tx in the B28a state can reach −7.5 dB.

Figure 20:
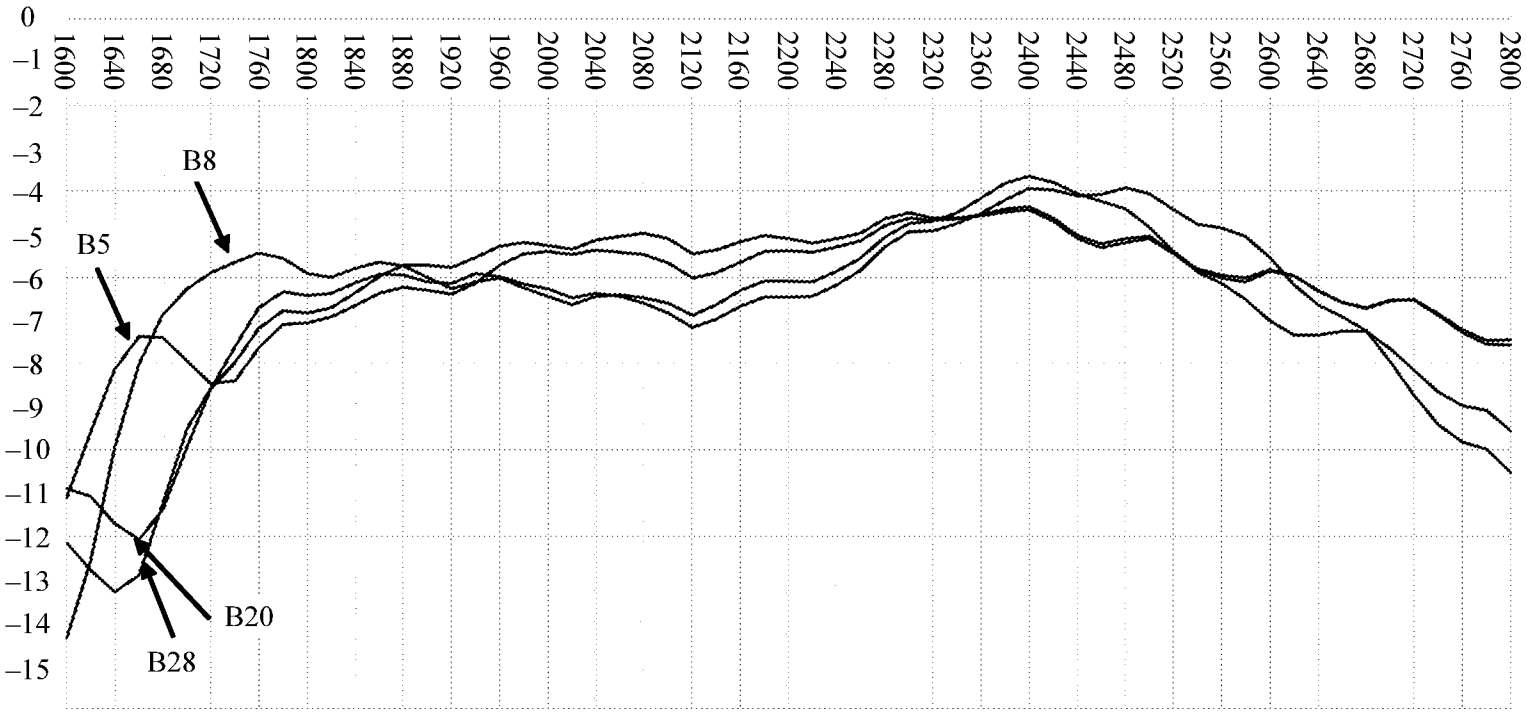
FIG. 20 shows another radiation efficiency curve of an MHB1 antenna in an embodiment.

FIG. 20 shows another radiation efficiency curve of an MHB1 antenna in an embodiment. It can be seen that, during LB tuning, efficiency fluctuations of the MHB1 antenna are very small. Actually, these small fluctuations are caused by a parasitic capacitor of a SPST switch. In B8 and B5 states, the MHB1 antenna can cover medium and high bands and achieve average efficiency of −5.0 dB to −5.5 dB.

Figure 21:
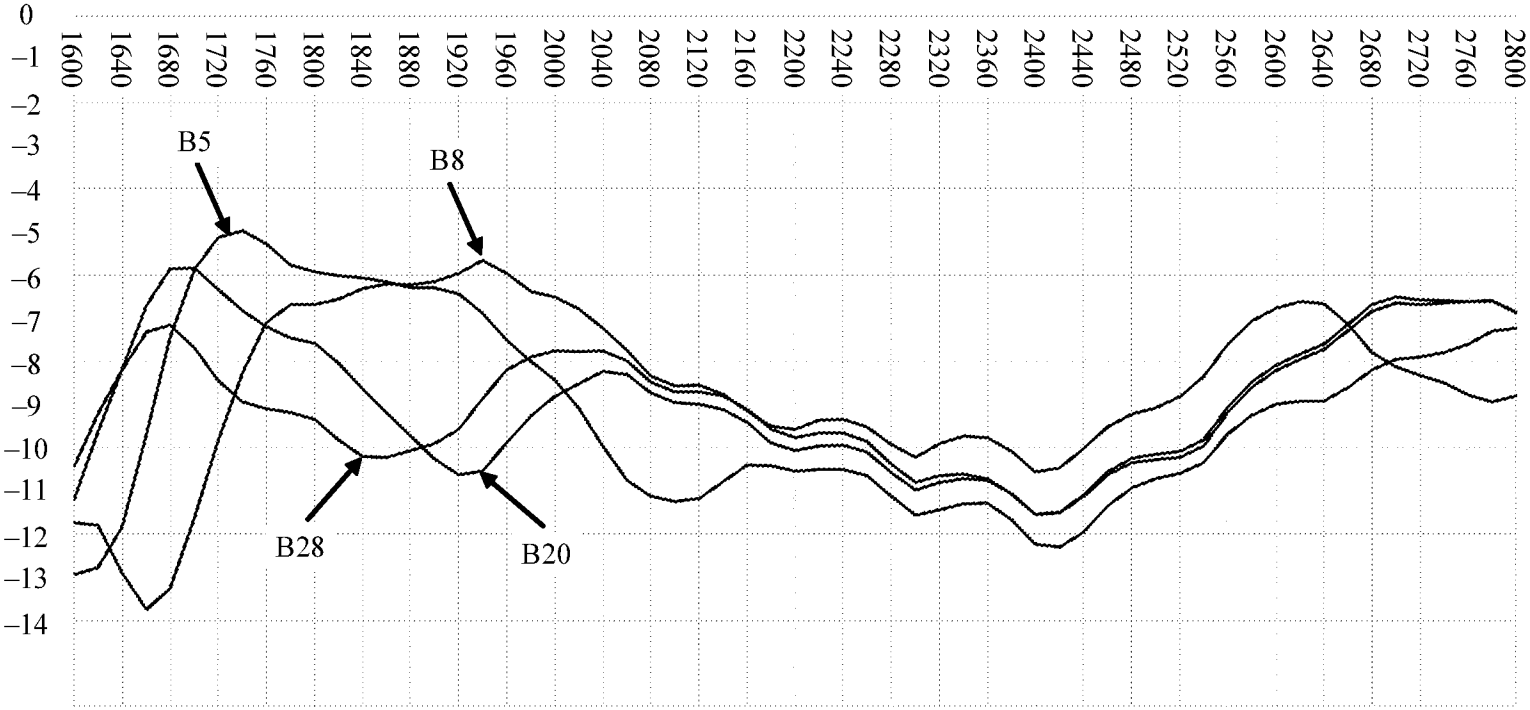
FIG. 21 shows another radiation efficiency curve of an MHB2 antenna in an embodiment.

FIG. 21 shows another radiation efficiency curve of an MHB2 antenna in an embodiment. In the entire medium and high bands, average radiation efficiency reaches −8.0 dB. The MHB2 antenna serving as a MIMO antenna is basically available. After being optimized, the MHB2 antenna can achieve average radiation efficiency higher than −6.5 dB in B3, B1, and B7 states.

A tunable decoupling capacitor may be in a bridge connection between a ground point of an LB antenna and a feed point of an MHB1 antenna. This capacitor has two functions (1) improving an isolation degree between two medium- and high-band antennas, and (2) implementing single-state tuning of the MHB1 antenna.

Two medium- and high-band antennas coexist in small space, and an isolation degree problem also occurs. Before the decoupling capacitor is loaded, the isolation degree between the two medium- and high-band antennas (the MHB1 and the MHB2) is about −6.0 dB.

Figure 22:
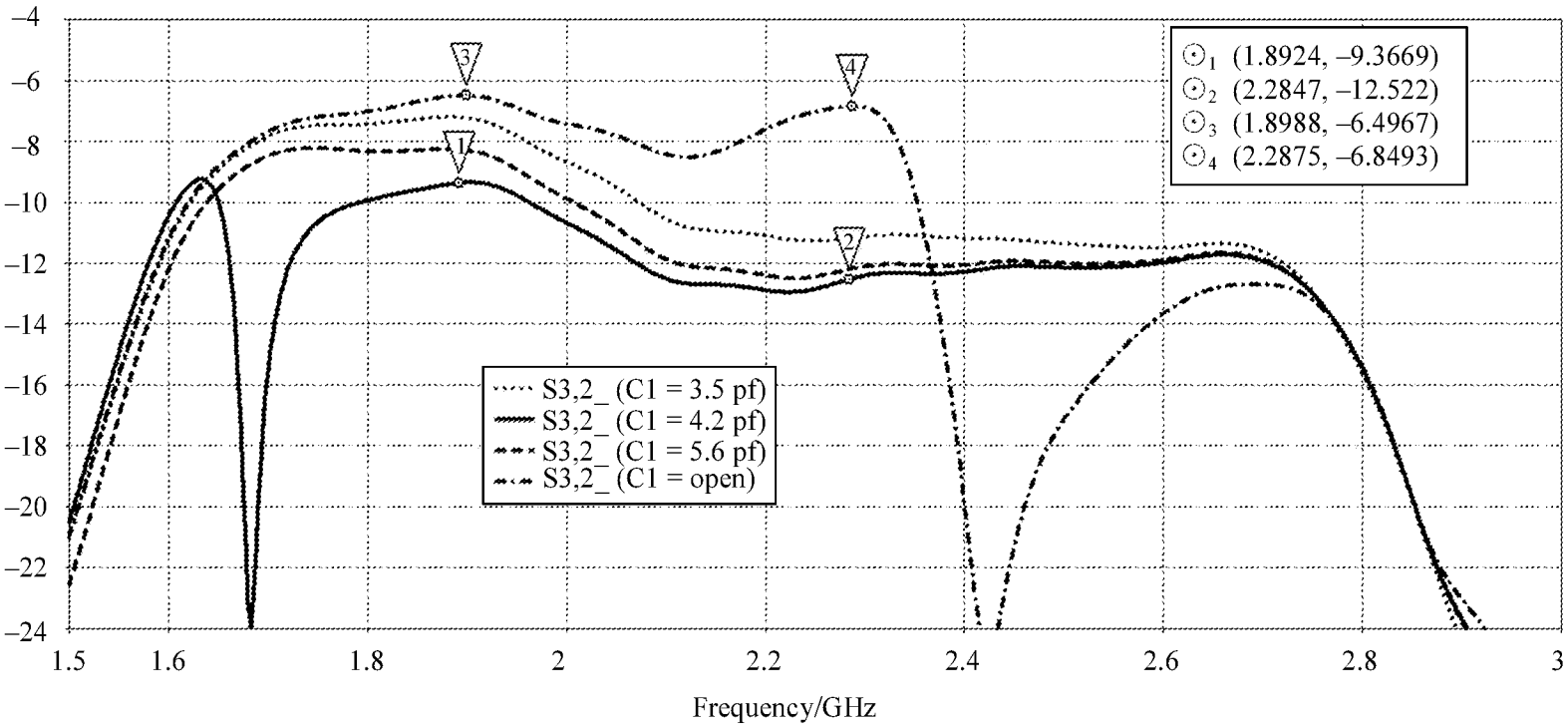
FIG. 22 is a schematic diagram of impact of a decoupling capacitor on an isolation degree between two medium- and high-band antennas.

FIG. 22 is a schematic diagram of impact of a decoupling capacitor on an isolation degree between two medium- and high-band antennas. Actually, there is an optimal capacitance value, that is, C=4.2 pf. The optimal capacitance value can make the isolation degree increase from initial −6.5 dB to −9.3 dB, and is improved by about 2.8 dB. A test result of a mobile phone B is better than a simulation result. In a B8 state, the isolation degree between the two medium- and high-band antennas is the worst, that is, S32=−10.8 dB.

Figure 23:
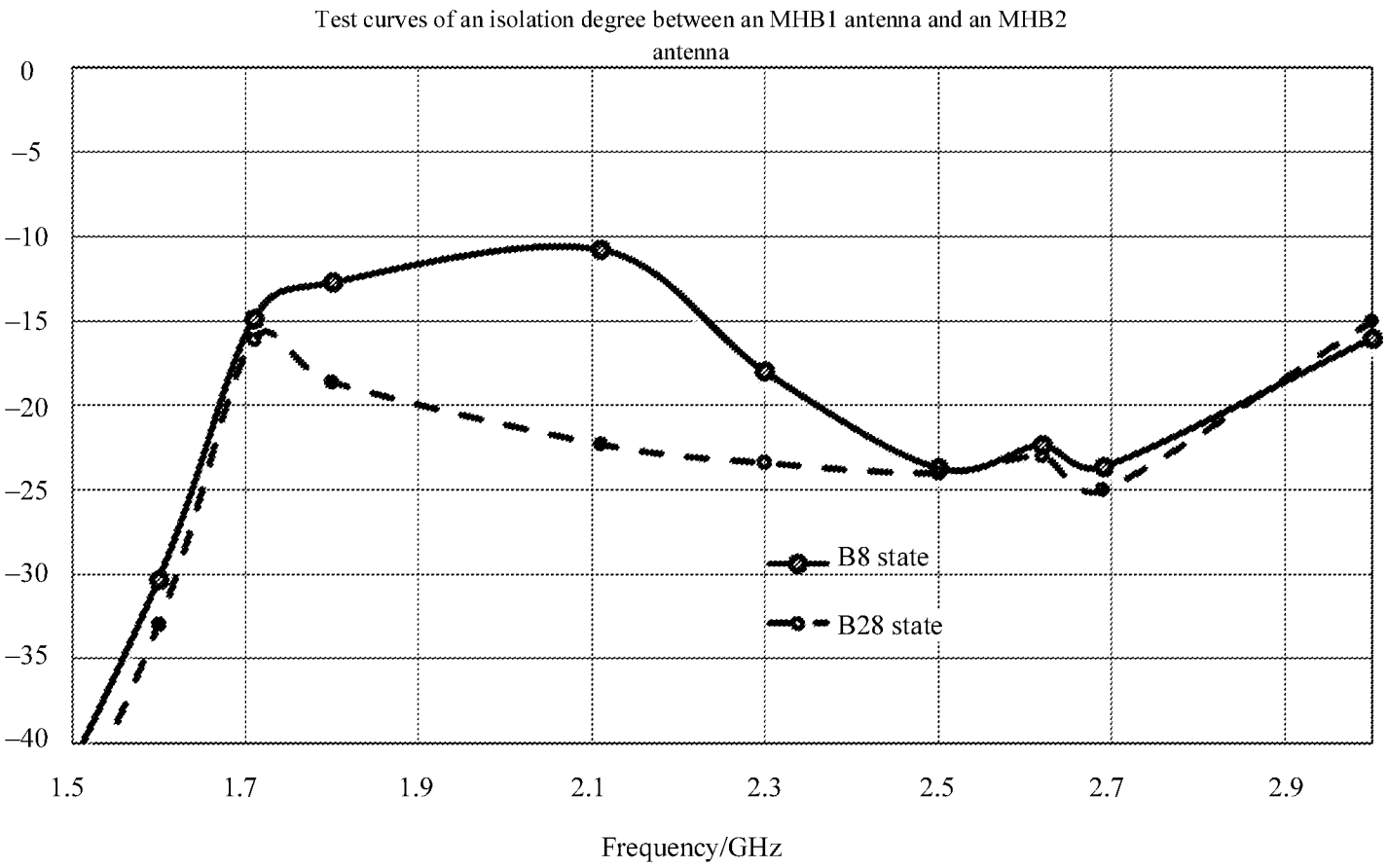
FIG. 23 shows test curves of an isolation degree between an MHB1 antenna and an MHB2 antenna in B8 and B28 states.

FIG. 23 shows test curves of an isolation degree between an MHB1 antenna and an MHB2 antenna in B8 and B28 states. It may be assumed that a feed point of an LB antenna is a first port, a feed point of the MHB1 antenna is a second port, and a feed point of the MHB2 antenna is a third port. A function of a decoupling capacitor is to weaken coupling between the second port and the third port, and distribute a part of energy to a ground terminal of the LB antenna. In addition, a width of a bottom slit and a form of a matching circuit of the second port and the third port also affect the isolation degree.

Figure 24:
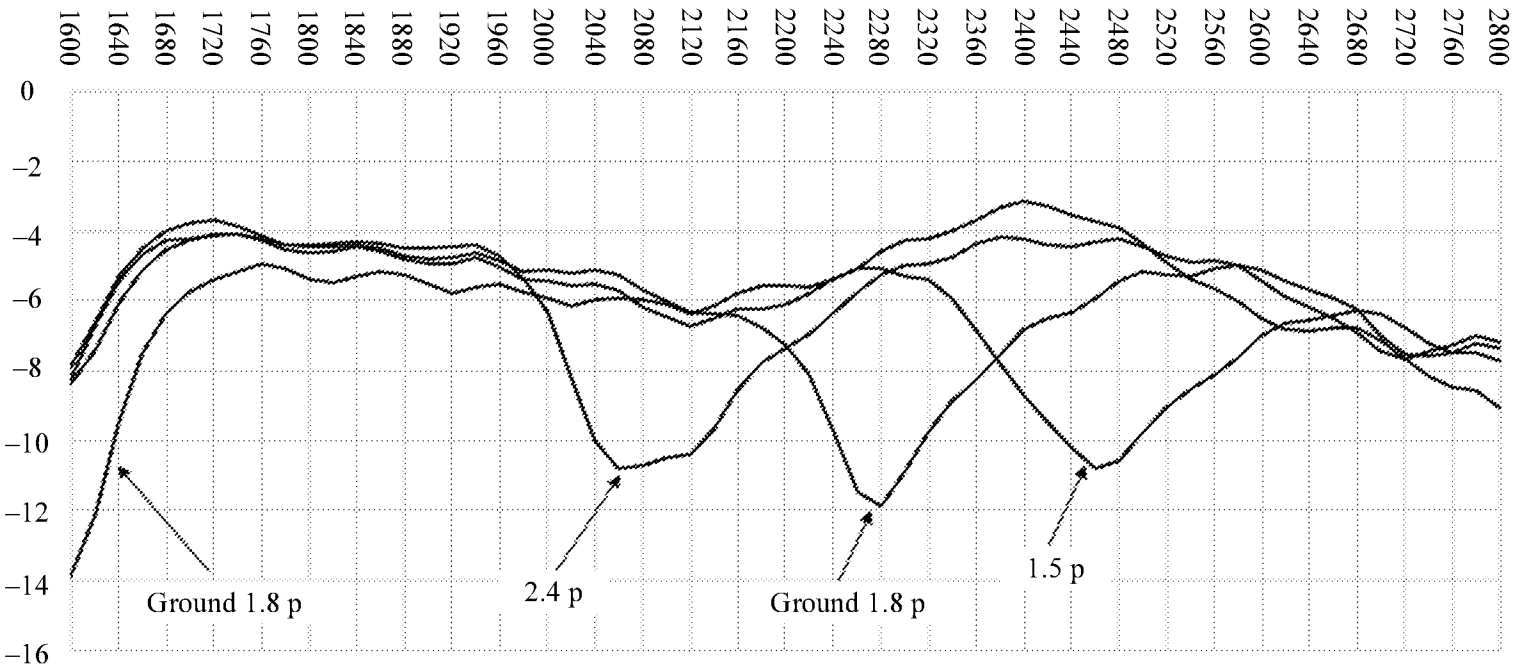
FIG. 24 is a schematic diagram of optimizing single-state radiation efficiency of an MHB1 antenna using a decoupling capacitor in an embodiment.

Another function of the decoupling capacitor is to implement single-state tuning of the MHB1 antenna. As shown in FIG. 24, when a capacitance value of a decoupling capacitor is 2.4 pf, efficiency in a B3 state can be improved by 1.5 dB, but a cost is that efficiency in a B1 state is reduced. Because the capacitance value of the decoupling capacitor may be designed to be tunable, in a tuning process of the capacitance value of the decoupling capacitor, average efficiency of the MHB1 antenna in each single state (in a state such as B3, B1, B40, or B7) may be improved by 1.0 dB to 1.5 dB.

The technical solution in the embodiments of this application is a method for designing a plurality of coexisting antennas in small space to meet a requirement of a future mobile phone for a plurality of MIMO antennas. Compared with a conventional design method in the industry, an additional MIMO antenna covering an entire band from 1.805 GHz to 2.69 GHz can be made in a same clearance condition. Actually, each of the MHB1 antenna and the MHB2 antenna has a potential to cover B32, B42, or B43.

As shown in FIG. 7, in the disassembled antennas, the LB antenna is in the middle, and the two medium- and high-band antennas are separated by the LB antenna. A band-stop matching circuit whose stopband is at medium and high bands may be designed for the LB antenna, and this has the following advantages.

(1) During LB tuning, interference from the LB antenna to the two medium- and high-band antennas is very small.

(2) Matching of the MHB1 antenna and the MHB2 antenna may be separately optimized. An isolation degree between the MHB1 antenna and the MHB2 antenna is improved and can be controlled below −11 dB.

Three independent paths are used for the LB antenna and the two medium- and high-band antennas. When carrier aggregation (CA) is applied, an insertion loss of a circuit power splitter/combiner can be reduced, and flexibility of CA configuration can be improved.

Figure 25:
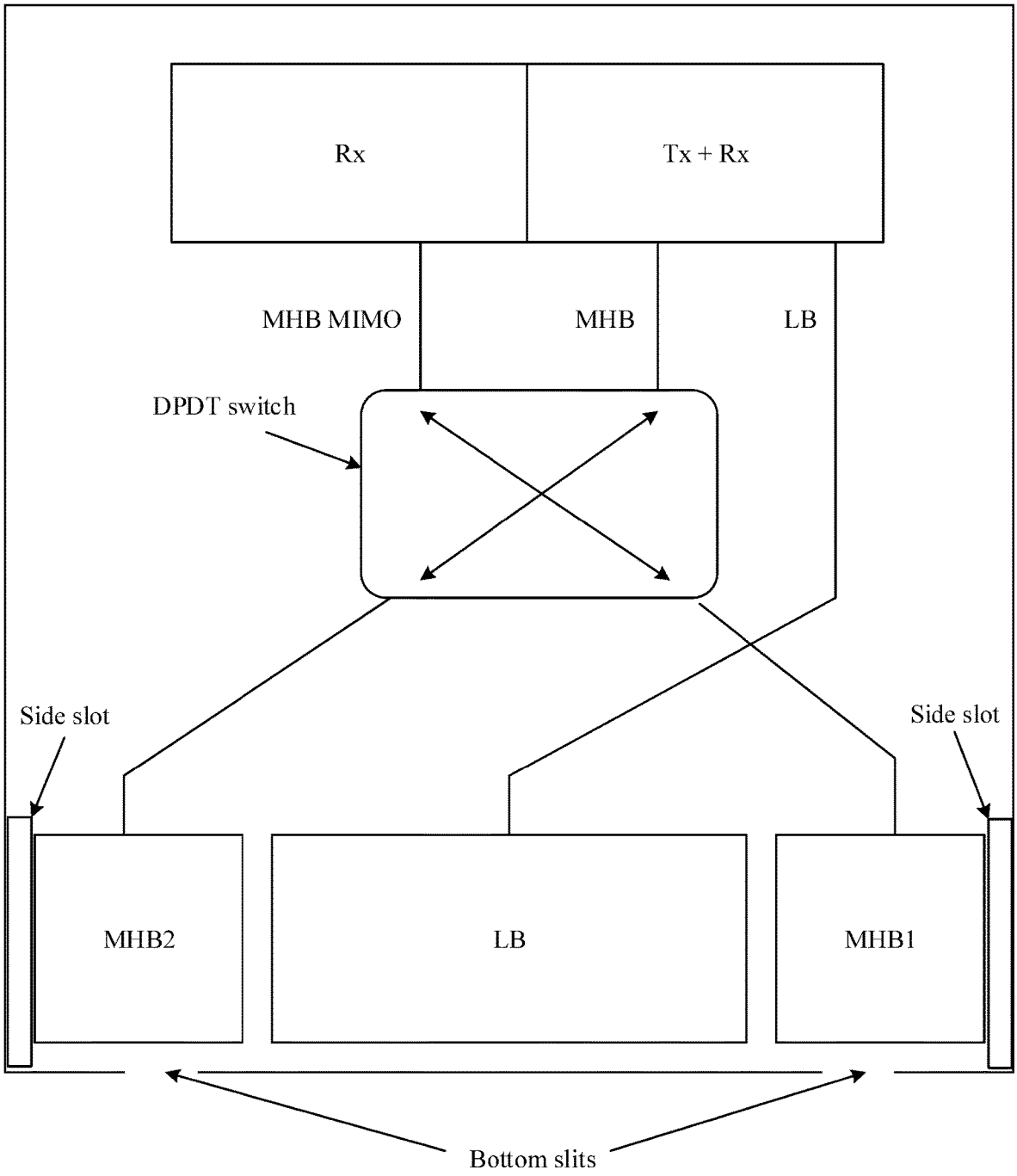
FIG. 25 is a schematic block diagram of an antenna apparatus according to an embodiment of this application.

An architecture of three antennas and a RF connection topology also have an advantage. FIG. 25 is a schematic block diagram of an antenna apparatus according to an embodiment of this application. As shown in FIG. 25, bands of an MHB1 antenna and an MHB2 antenna may be selected using a double-pole double-throw (DPDT) switch, and a band with high radiation efficiency is preferably selected to use for a main antenna of the medium- and high-band antennas. The MHB1 antenna is designed as the main antenna, but does not need to have high radiation efficiency in all bands. A band with high radiation efficiency of the MHB2 antenna may be used to replace a bad band of the MHB1 antenna.

A method for opening a bottom slit in an antenna helps avoid a "dead grip" problem of a mobile phone with a slit opened on a side, and also helps avoid a problem of switching between a main antenna and an auxiliary antenna. Logic for switching antennas is complex. So far, a problem of no switching or repeated switchback (a ping-pong effect) still exists. Therefore, in research and development processes of a product, this architecture can greatly simplify of antenna design and reduce a workload of commissioning, and can also improve system stability and user experience.

A coupling feeding manner is used for both the MHB1 antenna and the MHB2 antenna, and a primary feed coupling unit is placed on a PCB board or a sound box. A method for extending an antenna carrier is provided, to make an antenna structure three-dimensional. Coupling feeding can reduce a problem caused by electrical connection, and can also reduce production costs (a spring plate is omitted, and processing difficulty of a structural part is also simplified).

In an MHB1 antenna and an MHB2 antenna, slot antennas are designed using slots (natural slots of about 0.5 mm between a metal layer of a display unit and a metal frame) on two sides of a mobile phone. A new method is provided to solve a problem of how to design more antennas in narrow space.

A concept of a loop antenna is used for an LB antenna such that double resonance can be achieved in all tuning states, and a bandwidth of the LB antenna is extended by 10% to 15%. In this way, clearance of the antenna can be reduced to 2 mm to 3 mm.

An embodiment of this application further provides a terminal device. The terminal device includes the foregoing antenna apparatus, a metal middle frame, and an RF circuit. The antenna apparatus is connected to the RF circuit, and the antenna apparatus transmits a signal on the RF circuit using the metal middle frame.

It should be understood that the metal middle frame of the terminal device includes a metal frame of the terminal device.

A feed point of the antenna apparatus is connected to the RF circuit. For example, the feed point 101, the feed point 201, and the feed point 301 may be connected to the RF circuit. The antenna apparatus may convert an electrical signal on the RF circuit into a spatial signal using the metal middle frame of the terminal device, and transmit the spatial signal.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, refer to a corresponding process in the foregoing method embodiments, and details are not described herein.

In the several embodiments provided in this application, it should be understood that the disclosed system, apparatus, and method may be implemented in other manners. For example, the described apparatus embodiment is merely an example. For example, division into the units is merely logical function division and may be other division in an embodiment. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of this application essentially, or the part contributing to other approach, or some of the technical solutions may be implemented in a form of a computer software product. The computer software product is stored in a storage medium, and includes several instructions for instructing a computer device (which may be a personal computer, a server, a network device, or the like) to perform all or some of the steps of the methods described in the embodiments of this application. The foregoing storage medium includes any medium that can store program code, such as a USB flash drive, a removable hard disk, a read-only memory (ROM), a random access memory (RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An antenna apparatus comprising:

a first medium-band and high-band (MBHB) antenna, comprising:

a first feed point;

a first primary feed coupled to the first feed point; and a radiating slot constituted by a metal middle frame of a terminal device and a metal frame of the terminal device, wherein the radiating slot comprises:

a first end configured to couple to a first side slot of the metal middle frame and be grounded using the metal middle frame; and a second end of the radiating slot comprises an opening, wherein the opening of the second end is configured to be disposed at a bottom edge of the metal frame, wherein the first primary feed is spaced from the radiating slot and is orthogonally crossed over the radiating slot.

2. The antenna apparatus of claim 1, further comprising a low-band (LB) antenna comprising:

a second feed point;

a first straight arm comprising:

a third end coupled to the second feed point; and a fourth end;

a second straight arm comprising:

a fifth end coupled to the fourth end; and a sixth end; and a first ground point coupled to the sixth end and located on a right side of the second feed point.

3. The antenna apparatus of claim 2, wherein the LB antenna further comprises a matching circuit configured to isolate interference from the first MBHB antenna to the LB antenna, and wherein the first straight arm is connected to the second feed point using the matching circuit.

4. The antenna apparatus of claim 2, wherein the LB antenna further comprises a tuning point located on a left side of the second feed point and configured to connect to a seventh end of a switch, and wherein an eighth end of the switch is configured to connect to at least one load.

5. The antenna apparatus of claim 2, wherein the first straight arm is connected to the second straight arm using a metal sheet.

6. The antenna apparatus of claim 2, wherein the metal frame comprises a first bottom slit and a second bottom slit, and wherein the LB antenna is configured to be located between a first bottom slit of the metal frame and a second bottom slit of the metal frame.

7. The antenna apparatus of claim 2, wherein the antenna apparatus further comprises a second MBHB antenna comprising:

a third feed point; and a radiating element starting from a second ground point of a second side slot and crossing the metal frame to a third ground point of a third side slot.

8. The antenna apparatus of claim 7, wherein the second MBHB antenna further comprises a second primary feed located on a sound box of the terminal device and connected to the third feed point.

9. The antenna apparatus of claim 7, wherein the first ground point is configured to be connected to a capacitor to isolate the first MBHB antenna from the second MBHB antenna.

10. The antenna apparatus of claim 9, wherein a capacitance value of the capacitor is tunable.

11. The antenna apparatus of claim 1, wherein the first primary feed is located above or below the radiating slot, and wherein a spacing between the first primary feed and the radiating slot is within a range of 0.5 millimeters (mm) to 2 mm.

12. A terminal device, comprising:

a metal middle frame comprising a first side slot;

a metal frame coupled to the metal middle frame;

an antenna apparatus comprising a first medium-band and high-band (MBHB) antenna, wherein the first MBHB antenna comprises:

a first feed point;

a first primary feed coupled to the first feed point; and a radiating slot formed by the metal middle frame and the metal frame, wherein the first primary feed is spaced from the radiating slot and is orthogonally crossed over the radiating slot, wherein the radiating slot comprises:

a first end coupled to the first side slot and is grounded using the metal middle frame; and a second end, wherein an opening of the second end is disposed at a bottom edge of the metal frame; and a radio frequency circuit coupled to the antenna apparatus, and wherein the antenna apparatus transmits a signal on the radio frequency circuit using the metal middle frame.

13. The terminal device of claim 12, wherein the antenna apparatus further comprises a low-band (LB) antenna comprising:

a second feed point;

a first straight arm comprising:

a third end coupled to the second feed point; and a fourth end;

a second straight arm comprising:

a fifth end coupled to the fourth end; and a sixth end; and a first ground point coupled to the sixth end and located on a right side of the second feed point.

14. The terminal device of claim 13, wherein the LB antenna further comprises a matching circuit to isolate interference from the first MBHB antenna to the LB antenna, and wherein the first straight arm is connected to the second feed point using the matching circuit.

15. The terminal device of claim 13, further comprising at least one load and a switch, wherein the switch comprises a seventh end and an eighth end, wherein the LB antenna further comprises a tuning point located on a left side of the second feed point and is connected to the seventh end of the switch, and wherein the eighth end of the switch is connected to the at least one load.

16. The terminal device of claim 13, wherein the first straight arm is connected to the second straight arm using a metal sheet.

17. The terminal device of claim 13, wherein the metal frame comprises a first bottom slit and a second bottom slit, and wherein the LB antenna is located between the first bottom slit and the second bottom slit.

18. The terminal device of claim 13, wherein the antenna apparatus further comprises a second MBHB antenna comprising:

a third feed point; and a radiating element starting from a second ground point of a second side slot and crosses the metal frame to a third ground point of a third side slot.

19. The terminal device of claim 18, wherein the terminal device further comprises a sound box, wherein the second MBHB antenna further comprises a second primary feed located on the sound box and connected to the third feed point.

20. The terminal device of claim 18, wherein the first ground point is connected to a capacitor, and wherein the capacitor isolates the first MBHB antenna from the second MBHB antenna.

* * * * *